US011037493B2

(12) United States Patent
Chang

(10) Patent No.: US 11,037,493 B2
(45) Date of Patent: Jun. 15, 2021

(54) ELECTROLUMINESCENCE DISPLAY DEVICE INCLUDING GATE DRIVER

(71) Applicant: LG Display Co., Ltd., Seoul (KR)

(72) Inventor: Sungwook Chang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/716,192

(22) Filed: Dec. 16, 2019

(65) Prior Publication Data

US 2020/0202779 A1 Jun. 25, 2020

(30) Foreign Application Priority Data

Dec. 20, 2018 (KR) ..... 10-2018-0166478

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3266* (2013.01); *G09G 2310/0286* (2013.01); *G09G 2320/0233* (2013.01)

(58) Field of Classification Search
USPC ..... 345/76
See application file for complete search history.

(56) References Cited

U.S. PATENT DOCUMENTS

2011/0273418 A1* 11/2011 Park ..... H05B 45/60 345/211
2012/0062608 A1* 3/2012 Kim ..... G09G 3/3233 345/690

(Continued)

*Primary Examiner* — Chineyere D Wills-Burns
(74) *Attorney, Agent, or Firm* — Polsinelli PC

(57) ABSTRACT

An electroluminescence display device including a gate driver comprised of a plurality of stages, the gate driver comprises a $k^{th}$ stage for providing an emission signal to an $n^{th}$ pixel row (where n and k are natural numbers and $1 \le k \le n$); a first controller of the $k^{th}$ stage that is connected to the $k^{th}$ stage and providing an input signal; and a second controller of the $k^{th}$ stage that is connected to the $k^{th}$ stage and receiving an output signal of the $k^{th}$ stage as an input signal, wherein the first controller is implemented to generate a control signal for sensing the $n^{th}$ pixel row, and wherein the second controller is connected to an emission line, to which the emission signal is applied, to provide the output signal of the $k^{th}$ stage to the emission line, and the second controller is connected to a first controller of a $(k+1)^{th}$ stage to provide the output signal of the $k^{th}$ stage shifted to an emission carry signal to the first controller of the $(k+1)^{th}$ stage.

19 Claims, 14 Drawing Sheets

(51) Int. Cl.
*G09G 3/3275* (2016.01)
*G09G 3/20* (2006.01)

(56) References Cited

U.S. PATENT DOCUMENTS

| | | | | |
|---|---|---|---|---|
| 2016/0217728 | A1* | 7/2016 | In | G09G 3/3275 |
| 2016/0358666 | A1* | 12/2016 | Pang | G09G 3/3688 |
| 2016/0379558 | A1* | 12/2016 | Jeon | G11C 19/184<br>345/213 |
| 2017/0116926 | A1* | 4/2017 | Bong | G11C 19/186 |
| 2017/0193899 | A1* | 7/2017 | Yoon | G09G 3/3233 |
| 2018/0053462 | A1* | 2/2018 | Bae | G09G 3/2074 |
| 2018/0137825 | A1* | 5/2018 | An | G09G 3/3266 |
| 2018/0144711 | A1* | 5/2018 | Noh | G09G 3/3266 |
| 2018/0314380 | A1* | 11/2018 | Uehara | G06F 3/0412 |
| 2019/0096321 | A1* | 3/2019 | Yang | H01L 27/124 |
| 2020/0051496 | A1* | 2/2020 | Kang | G09G 3/3233 |

* cited by examiner

ELECTROLUMINESCENCE DISPLAY DEVICE INCLUDING GATE DRIVER

CROSS REFERENCE TO RELATED APPLICATION

This application claims the benefit of Korean Patent Application No. 10-2018-0166478 filed on Dec. 20, 2018, which is hereby incorporated by reference in its entirety.

BACKGROUND

Field of the Disclosure

The present disclosure relates to a display device, and more particularly, to an electroluminescence display device including a gate driver, which can selectively output a random signal to a specific pixel row.

Description of the Background

An electroluminescence display device may be categorized into an inorganic light emitting display device and an organic light emitting display device in accordance with materials of a light emitting layer. An organic light emitting display device of an active matrix type includes an organic light emitting diode (OLED) which self-emits light, and has advantages in that a response speed is fast, luminance efficiency and luminance are high, and a viewing angle is wide.

The organic light emitting display device displays an input image by using a self-light emitting diode such as OLED. The OLED includes an anode electrode, a cathode electrode, and an organic compound layer formed between the anode electrode and the cathode. The organic compound layer includes a hole injection layer (HIL), a hole transport layer (HTL), an emission layer (EML), an electron transport layer (ETL), and an electron injection layer (EIL). If a power voltage is applied to the anode electrode and the cathode electrode, holes which have passed through the hole transport layer and electrons which have passed the electron transport layer are moved to form exciton, whereby the emission layer emits visible light.

A driving circuit of the electroluminescence display device includes a data driver for supplying data signals to data lines, and a gate driver for supplying gate signals to gate lines. The gate driver may directly be formed on the same substrate together with circuit elements of a display area constituting a screen. The gate driver directly formed on a substrate of a display panel together with circuit elements may be referred to as a gate in panel (GIP) circuit. The circuit elements of the display area constitute a pixel circuit formed in each of pixels defined in a matrix arrangement by data lines and gate lines of a pixel array. Each of the circuit elements of the display area and the gate driver includes a plurality of transistors.

A gate signal and a data signal are supplied to the display area, and the gate signal includes a scan signal and an emission signal. The pixels in the display area are driven using the emission signal and one or more scan signals. Generally, a gate driver which generates a scan signal may include a shift register for sequentially outputting gate signals.

The GIP type gate driver comprises a plurality of stages corresponding to the number of gate lines, wherein each stage outputs a gate signal supplied to gate lines to which the stages correspond one to one. The gate line supplies the gate signal to the pixel array arranged in the display area to allow a light emitting diode to emit light.

The light emitting diode generates heat as well as light while emitting light, and heat generated from the light emitting diode enhances a surface temperature of the display area, whereby non-uniform luminance may occur. Therefore, a method for enhancing picture quality by compensating for non-uniform luminance of the display panel has been studied.

A digital display device writes data in pixels in a progressive scan method. The progressive scan method writes in sequence data in all lines of a display area for a vertical active time period of one frame period. For example, after data are simultaneously written in pixels of a first pixel row, the data are simultaneously written in pixels of a second pixel row, and then the data are simultaneously written in pixels of a third pixel row. In this way, data per one line in the display panel are sequentially written in pixels of all pixel rows. In order to implement the progressive scan method, the gate driver may shift an output using a shift register and sequentially supply the gate signal to the gate lines.

Each of the pixels is divided into a plurality of subpixels having different colors to display color, and each subpixel includes a transistor used as a switching element or a driving element. The transistor may be implemented as a thin film transistor (TFT). The gate driver supplies the gate signal to a gate of the transistor formed in each pixel to turn on or off the transistor.

Each pixel circuit of the display area includes a plurality of transistors. Gate signals having different waveforms may be applied to the plurality of transistors. The display device requires as many gate drivers as the number of gate signals applied to the pixel circuit. The gate driver includes a shift register, and requires lines to which a start signal, a clock, etc. for controlling the shift register are transmitted.

As described above, in order to compensate for non-uniform luminance of the display panel, it is required to irregularly change a shift of a gate signal within a vertical display period in accordance with a driving method of pixels including the case that states of pixels in the display area are sensed and compensated. In this case, since the shift register of the existing gate driver generates an output in accordance with a clock timing having a predetermined cycle, it is difficult to output the gate signal to a random pixel row of the display panel within the vertical display period regardless of the clock timing by using an output method different from the progressive scan method.

Therefore, inventors of the present disclosure have recognized the aforementioned problems and invented an electroluminescence display device including a gate driver, which may change a gate signal applied to a random line of a display panel.

SUMMARY

The present disclosure has been made in view of the above problems, and the present disclosure provides an electroluminescence display device including a gate driver, which may change a gate signal provided to a random pixel row of a display panel within a progressive scan process.

Additional aspects and features of the present disclosure will be clearly understood by those skilled in the art from the following description of the present disclosure.

In accordance with an aspect of the present disclosure, the above and other objects can be accomplished by the provision of an electroluminescence display device comprising a gate driver comprised of a plurality of stages, the gate driver including a $k^{th}$ stage for providing an emission signal to an nth pixel row, a first controller connected to the $k^{th}$ stage, providing an input signal, and a second controller connected to the $k^{th}$ stage, receiving an output signal of the $k^{th}$ stage as an input signal. The first controller is implemented to generate a control signal for sensing the nth pixel row, and the second controller is connected to an emission line, to which the emission signal is applied, to provide the output signal of the $k^{th}$ stage to the emission line, and is connected to a first controller of a $(k+1)^{th}$ stage to provide the output signal of the $k^{th}$ stage shifted to an emission carry signal to the first controller of the $(k+1)^{th}$ stage. In this case, n and k are natural numbers, and $1 \leq k \leq n$. Therefore, a random gate signal may selectively be applied to a specific pixel row to sense and compensate for the specific pixel row. As a result, non-uniform luminance of the display panel may be compensated in real time, whereby picture quality of the electroluminescence display device may be improved and its lifespan may be extended.

In accordance with another aspect of the present disclosure, the above and other objects can be accomplished by the provision of an electroluminescence display device comprising a sensing scan driver including a plurality of stages for applying a sensing signal to a specific pixel row, an emission driver including a plurality of stages for applying an emission signal to the specific pixel row, a first controller for providing an input signal to the emission driver, and a second controller for receiving an output signal of the emission driver as an input signal, wherein electrical characteristics of a driving device included in the specific pixel row are sensed through a sensing period, and a gate on voltage is output through the sensing scan driver and the emission driver for the sensing period. Therefore, a random gate signal may selectively be applied to the specific pixel row to sense and compensate for the specific pixel row. As a result, non-uniform luminance of the display panel may be compensated in real time, whereby picture quality of the electroluminescence display device may be improved and its lifespan may be extended.

Details of the other aspects are included in the detailed description and drawings.

According to the aspects of the present disclosure, a first controller for providing an input signal to an emission driver and a second controller for receiving an output signal of the emission driver may be provided, whereby a random signal may be provided to a gate line of a specific pixel row.

Also, according to the aspects of the present disclosure, the first controller further includes a transistor connected to its output node and a first sub capacitor, and the second controller further includes a second sub capacitor connected to its output node, whereby stability and reliability of an emission driver for IFS may be improved.

In addition to the effects of the present disclosure as mentioned above, additional advantages and features of the present disclosure will be clearly understood by those skilled in the art from the above description of the present disclosure.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
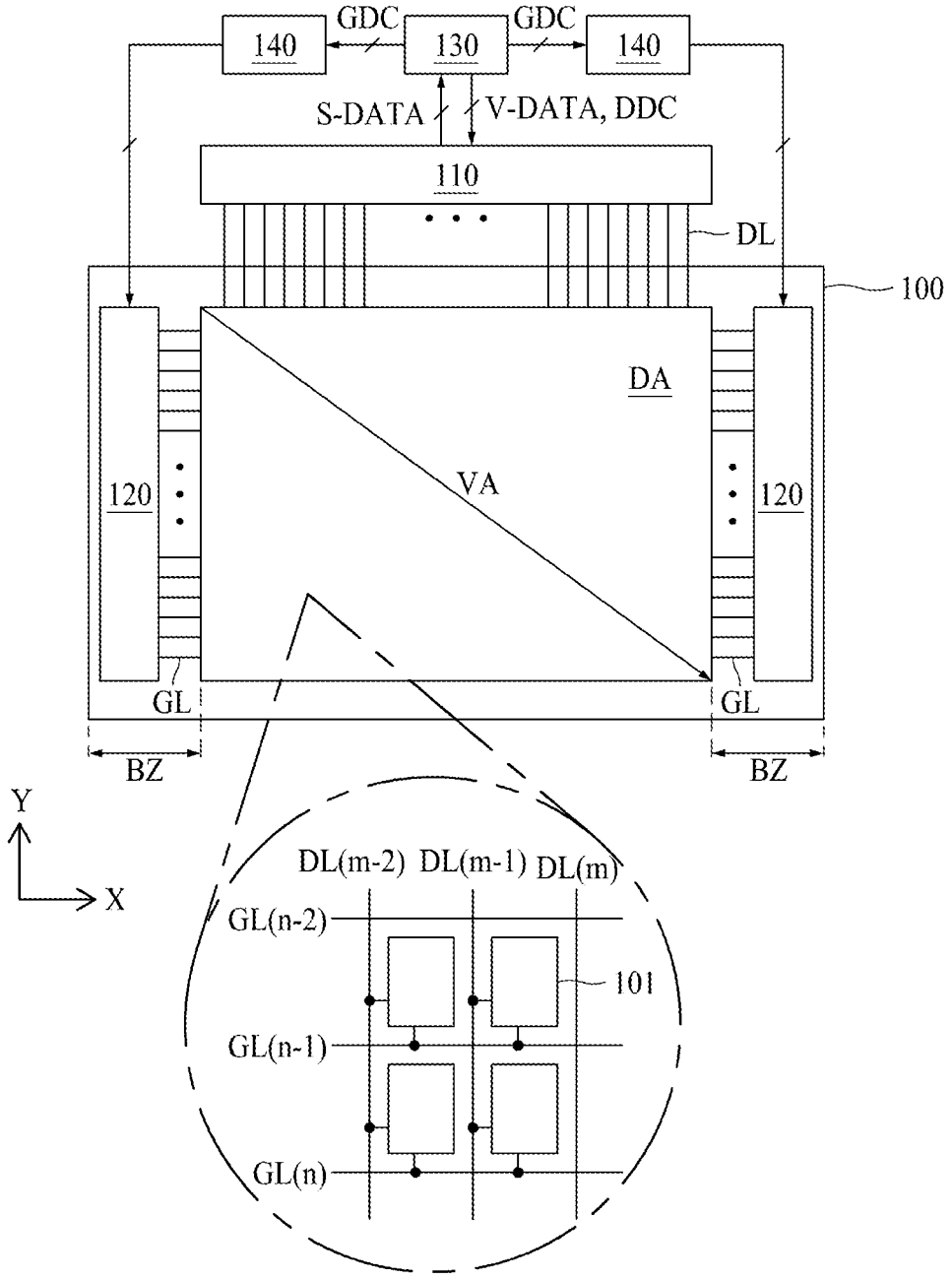
FIG. 1 is a block view illustrating an electroluminescence display device according to one aspect of the present disclosure.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above~', 'below~', and 'next to~', one or more portions may be arranged between two other portions unless 'just' or 'direct' is used.

In describing a time relationship, for example, when the temporal order is described as 'after~', 'subsequent~', 'next~', and 'before~', a case which is not continuous may be included unless 'just' or 'direct' is used.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

In the present disclosure, a gate driver formed on a substrate of a display panel may be implemented with an N-type or P-type transistor. For example, the transistor may be implemented with a transistor having a metal oxide semiconductor field effect transistor (MOSFET) structure. The transistor may be a three-electrode device including a gate, a source, and a drain. The source supplies a carrier to the transistor. In the transistor, the carrier starts to move from the source. The drain may be an electrode through which the carrier moves from the transistor to the outside.

For example, in the transistor, the carrier moves from the source to the drain. In an n-type transistor, since the carrier is an electron, a voltage of the source is lower than a voltage of the drain in order for the electron to move from the source to the drain. In the N-type transistor, since the electron moves from the source to the drain, a current moves from the drain to the source. In a P-type transistor, since the carrier is a hole, the voltage of the source is higher than the voltage of the drain in order for the hole to move from the source to the drain. In the P-type transistor, since the hole moves from the source to the drain, a current moves from the source to the drain. The source and the drain of the transistor may not be fixed and may be switched in accordance with an applied voltage. Therefore, the source and the drain may respectively be referred to as a first electrode and a second electrode or the second electrode and the first electrode.

Hereinafter, a gate on voltage may be a voltage of a gate signal for turning on a transistor. A gate off voltage may be a voltage for turning off the transistor. For example, in a P-type transistor, the gate on voltage may be a logic low voltage, and the gate off voltage may be a logic high voltage. In an N-type transistor, the gate on voltage may be a gate high voltage, and the gate off voltage may be a gate low voltage. The gate high voltage may be equal to an emission high voltage, and the gate low voltage may be equal to an emission low voltage.

Hereinafter, a gate driver and an electroluminescence display device using the same according to the present disclosure will be described with reference to the accompanying drawings.

FIG. 1 is a block view illustrating an electroluminescence display device according to one aspect of the present disclosure.

Referring to FIG. 1, the electroluminescence display device comprises a display panel 100 and a display panel driving circuit.

The display panel 100 includes a display area DA displaying data of an input image. A pixel array is arranged in the display area DA. The pixel array includes a plurality of data lines DL, a plurality of gate lines GL which cross the data lines DL, and pixels arranged in an area defined by the data lines DL and the gate lines GL. The pixels may be arranged in various shapes such as a matrix shape, a shape sharing pixels emitting light of the same color, a stripe shape, and a diamond shape in accordance with light emission areas.

Each pixel may include a red subpixel, a green subpixel, and a blue subpixel to display colors. Each pixel may further include a white subpixel or a plurality of subpixels implementing the same color. Each subpixel 101 includes a pixel circuit. In case of the electroluminescence display device, the pixel circuit includes a light emitting diode, a plurality of transistors, and a capacitor. The pixel circuit is connected to the data line DL and the gate line GL. In a circle of FIG. 1, "DL(m−2), DL(m−1) and DL(m)" denote the data lines, and "GL(n−2), GL(n−1) and GL(n)" denote the gate lines.

Touch sensors may be arranged on the display panel 100. A touch input may be sensed using separate touch sensors or sensed through the pixels. The touch sensors may be implemented as on-cell type touch sensors or add-on type touch sensors and arranged on a screen of the display panel 100. Alternatively, the touch sensors may be implemented as in-cell type touch sensors that are embedded in the pixel array.

The display panel driving circuit includes a data driver 110 and a GIP type gate driver 120. The display panel driving circuit writes data of an input image in the pixels of the display panel 100 under the control of a timing controller 130. The display panel driving circuit includes a data driver 110 and a gate driver 120, which are driven under the control of the timing controller 130.

The data driver 110 outputs a data voltage to be supplied to pixels of all pixel rows of the display panel 100 within a vertical display period VA. When the pixel array of the display panel 100 includes n*m pixels, the display panel 100 includes m data lines DL and n gate lines GL. Therefore, the vertical display period VA includes n*m pixels.

The data voltage may be divided into a video data voltage for display and a sensing data voltage. The data voltage for display is a data voltage of an input image. The sensing data voltage is a data voltage for sensing electrical characteristics of the subpixels, and is a specific voltage which is previously set regardless of data of the input image.

The gate driver 120 may be formed in a bezel area BZ of the display panel 100, on which an image is not displayed. The gate driver 120 outputs a gate signal under the control of the timing controller 130 and selects pixels charged with the data voltage through the gate lines GL. The gate driver 120 outputs and shifts the gate signal by using one or more shift registers. The gate driver 120 shifts the gate signal supplied to the gate lines to a specific gate line previously set within the vertical display period VA at certain shift timing and then supplies a gate signal of a specific voltage to the specific gate line in response to a sensing control signal. Afterwards, the gate driver 120 shifts the gate signal supplied to the other gate lines at certain shift timing.

The timing controller 130 receives digital video data of an input image and timing signals synchronized with the digital video data from a host system. The timing signals include a vertical synchronization signal, a horizontal synchronization signal, a clock signal, a data enable signal, and the like. The host system may be one of a television (TV), a set-top box, a navigation system, a personal computer (PC), a home theater, a mobile device, and a wearable device. In the mobile device and the wearable device, the data driver 110, the timing controller 130, the level shifter 140, and the like may be integrated into one drive integrated circuit (IC).

The timing controller 130 generates a data timing control signal DDC for controlling operation timing of the data driver 110 and a gate timing control signal GDC for controlling operation timing of the gate driver 120 based on the timing signals received from the host system.

The level shifter 140 converts voltages of the gate timing control signal GDC output from the timing controller 130 into the gate-on voltage and the gate-off voltage and supplies them to the gate driver 120. A low level voltage of the gate timing control signal GDC is converted into a gate on voltage, and a high level voltage of the gate timing control signal GDC is converted into a gate off voltage.

The gate timing control signal GDC includes a start signal, a clock, and the like. The start signal is early generated once in each frame period and is input to the gate driver 120. The start signal controls a start timing of the gate driver 120 in each frame period. The clock controls a shift timing of the gate signal output from the gate driver 120.

Figure 2:
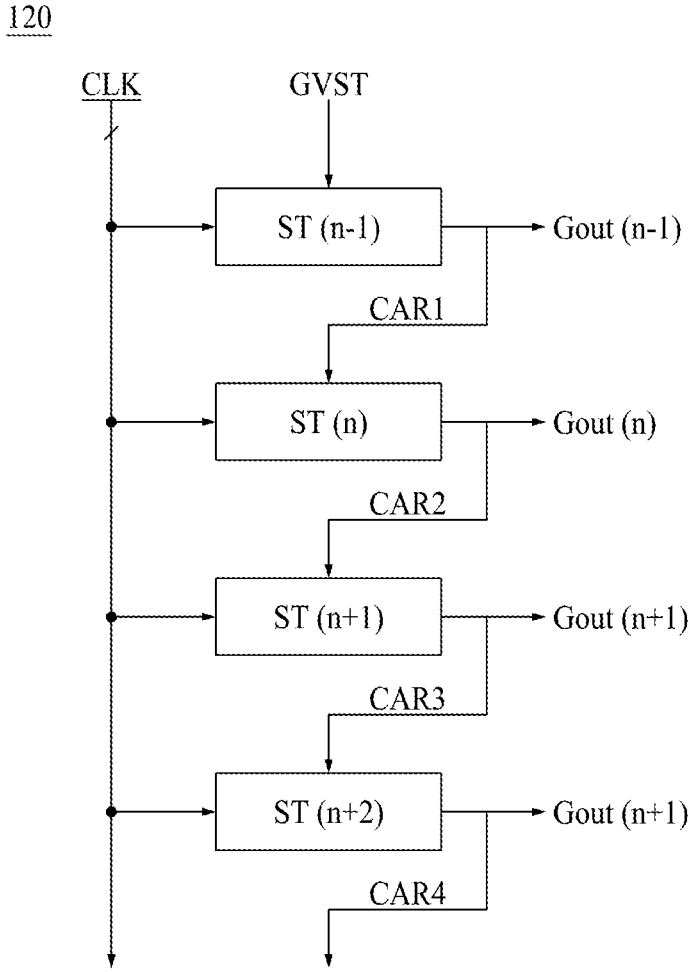
FIG. 2 is a view illustrating a circuit configuration of a gate driver according to one aspect of the present disclosure.

FIG. 2 is a view illustrating a circuit configuration of a gate driver according to one aspect of the present disclosure. In detail, FIG. 2 briefly shows a circuit configuration of a shift register in the gate driver 120.

A shift register of the gate driver 120 includes cascade-connected stages ST(n−1) to ST(n+2). The shift register receives a gate start signal GVST or carry signals CAR1 to CAR4 received from a previous stage as the start signals and generates outputs Gout(n−1) to Gout(n+2) in accordance with a timing of clock CLK. Hereinafter, the start signal indicates the gate start signal GVST or the carry signals CAR1 to CAR4 that are generated by a previous stage and applied to a start signal input node of a current stage.

The gate driver 120 includes a scan driver and an emission driver. A plurality of scan drivers may exist in accordance with types of scan signals. Each of the scan driver and the emission driver includes a plurality of stages as shown in FIG. 2. Each of the plurality of stages constituting the scan driver and the emission driver may apply a scan signal or an emission signal to one pixel row. Alternatively, each of the plurality of stages constituting the scan driver and the emission driver may apply a scan signal or an emission signal to two pixel rows that are odd and even numbered rows. Each of the plurality of stages constituting the scan driver may be implemented as, but not limited to, a circuit of FIG. 5A, and each of the plurality of stages constituting the emission driver may be implemented as, but not limited to, a circuit of FIG. 11.

An internal compensation method or an external compensation method may be applied to the electroluminescence display device to reduce degradation of subpixels and increase lifespan of the subpixels. Electrical characteristics of pixels such as a threshold voltage of a driving element, electron mobility of a driving element, and a threshold voltage of an OLED are factors for determining a driving current and thus should equally be applied to all the pixels. However, there may be a variation in the electrical characteristics between the pixels due to various causes including a process variation, changes over time, etc. Also, non-uniform luminance of the display panel may be generated due to heat generated from the light emitting diode. The variation in these electrical characteristics between the pixels and non-uniform luminance may result in deterioration in picture quality of the display panel and reduction in lifespan of the display panel.

The internal compensation method samples a gate-to-source voltage of the driving element using a compensation circuit arranged inside a pixel circuit and senses a threshold voltage of the driving element, thereby compensating for a data voltage with the sensed threshold voltage. The external compensation method senses a voltage of a pixel, that is changed depending on electrical characteristics of the driving element, through a sensing path connected to the subpixel and modulates data of an input image based on the sensed voltage using an external circuit outside the pixel array, thereby compensating for changes in the electrical characteristics of the driving element.

In order to sense and compensate for the electrical characteristics of the driving element in the same manner as the external compensation method, the electrical characteristics may be sensed and compensated when it can make sure of a sensing period in a state that there is no screen driving before or after screen driving. Since the time required for sensing in one pixel row is 40 horizontal period to 100 horizontal period, approximately, it is difficult to make sure of the time capable of sensing all pixel rows in the middle of driving.

The electroluminescence display device according to one aspect of the present disclosure may sense one pixel row or a plurality of pixel rows in a unit of one frame to compensate for variation in electrical characteristics of the subpixel and non-uniform luminance in real time. For example, a process of applying a data voltage, which is compensated by extracting sensing data through a sensing line implemented in a pixel circuit arranged in one pixel row and calculating a compensation coefficient through computation, to a corresponding pixel circuit may be performed repeatedly per frame. This sensing method may be defined as in frame sensing (IFS).

For example, after one frame is performed such that a $k^{th}$ pixel row is sensed and the other pixel rows are normally driven, $(k+1)^{th}$ pixel row is sensed in next frame and the compensated data voltage calculated by sensing is applied to the $k^{th}$ pixel row for normal driving and one frame is performed for the other pixel rows for normal driving. In this way, after sensing and compensation are performed for all pixel rows, normal driving may be performed in real time.

Figure 3A:
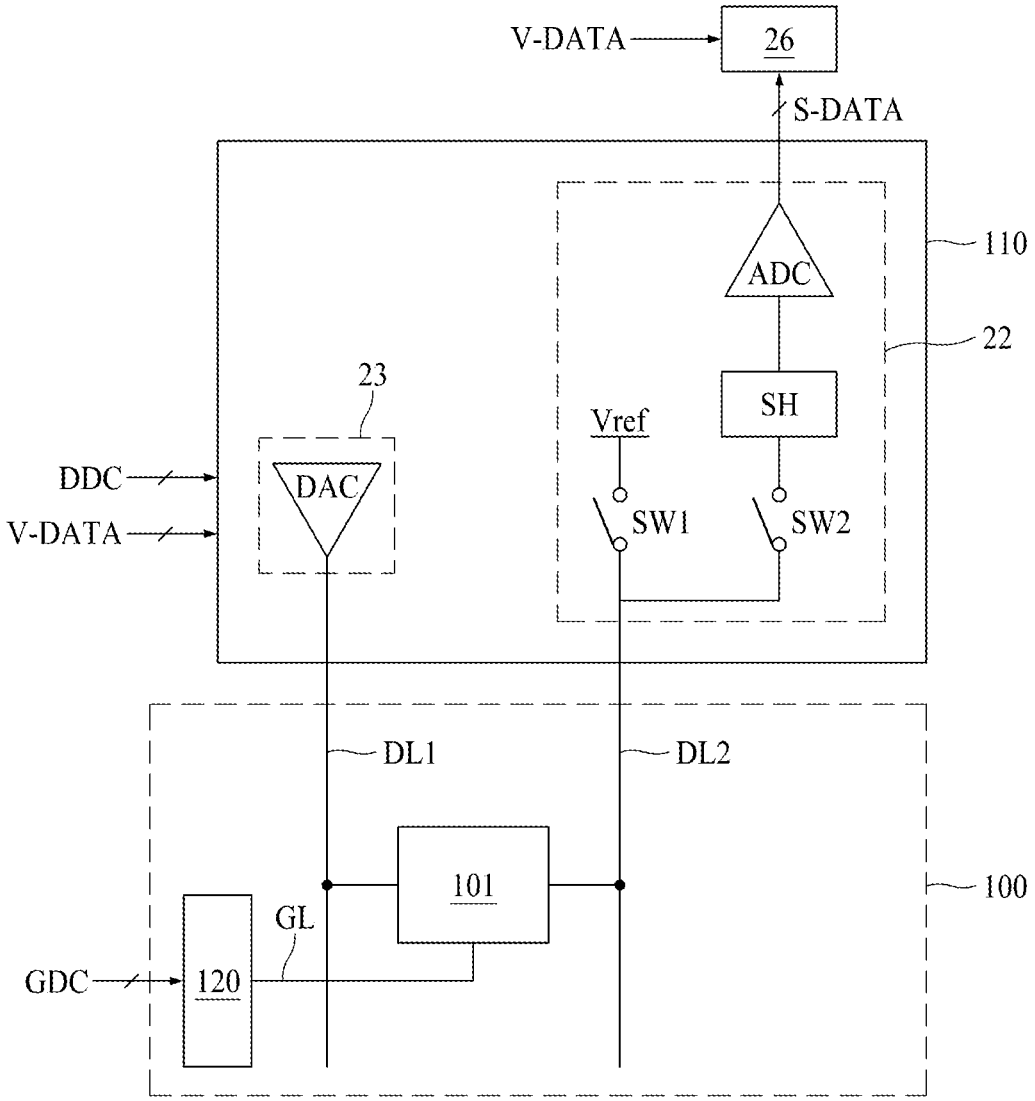
FIGS. 3A and 3B are views illustrating a sensing path connected to subpixels.
Figure 3B:
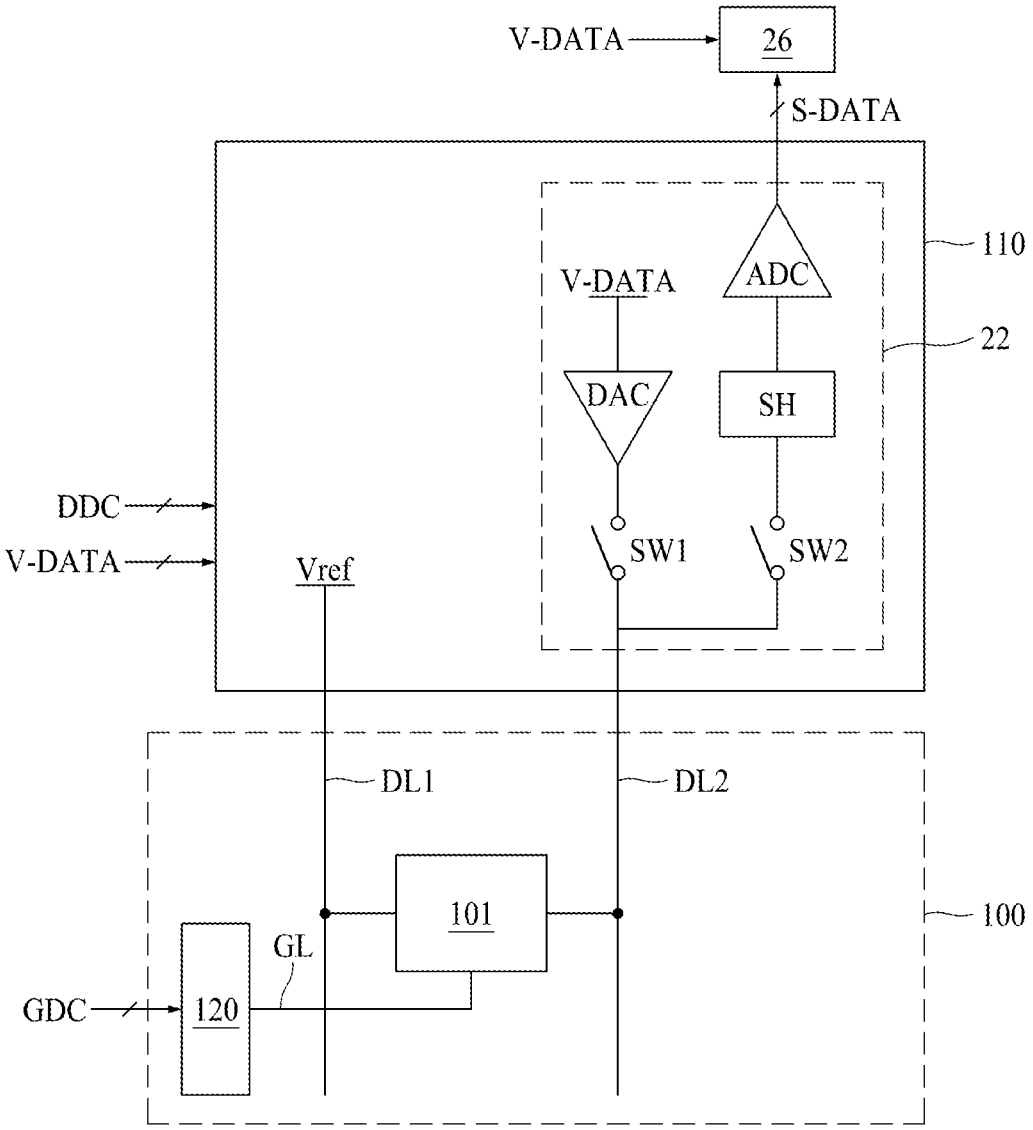

FIGS. 3A and 3B are views illustrating a sensing path connected to subpixels.

Referring to FIG. 3A, in a sensing mode performed within on frame in real time, the data driver 110 generates a sensing data voltage, and supplies the sensing data voltage to sensing subpixels 101 of the display panel 100 through the data lines DL. The data driver 110 includes a sensing unit 22 connected to a sensing path and a data voltage generator 23. The sensing unit 22 includes a data line DL1 to DL2 connected to the subpixel 101, switching elements SW1 and SW2, a sample and hold circuit SH, and an analog-to-digital converter (ADC). The data voltage generator 23 includes a digital-to-analog converter (DAC).

The data voltage generator 23 generates a data voltage through the DAC and supplies the data voltage to the first data line DL1. When a gate signal synchronized with the data voltage is supplied to a gate line GL, the data voltage is supplied to the subpixel 101. The data voltage includes a display data voltage and a sensing data voltage.

The sensing unit 22 is connected to the subpixel 101 through the second data line DL2. The sensing unit 22 includes the sample and hold circuit SH, the ADC, and the first and second switching elements SW1 and SW2. The sensing unit 22 may sample a voltage of the second data line DL2, which varies depending on a current of a driving element and thus sense electrical characteristics of the driving element. The first switching element SW1 supplies a reference voltage Vref to the second data line DL2 to initialize voltages applied to the subpixel 101 and the second data line DL2. The second switching element SW2 is turned on for a sensing period of a specific gate line and connects the second data line DL2 to the sample and hold circuit SH. A position of the specific gate line may be changed every frame period or every predetermined time so that all the subpixels of the display panel 100 may be sensed.

The sample and hold circuit SH samples and holds an analog sensing voltage of the subpixel 101 charged in the second data line DL2. The ADC converts the analog sensing voltage of the subpixel 101 sampled by the sample and hold circuit SH into digital sensing data S-DATA. The sensing unit 22 may be implemented as a known voltage sensing circuit or a known current sensing circuit. The digital sensing data S-DATA output from the sensing unit 22 is transmitted to a compensator 26. The compensator 26 is included in the timing controller 130.

The compensator 26 computes a compensation value set in a lookup table with video data V-DATA of an input image in accordance with a sensing value and modulates the video data V-DATA, thereby compensating for changes in electrical characteristics of the subpixel 101. The lookup table receives the digital sensing data S-DATA and the video data V-DATA of the input image as a memory address and outputs the compensation value stored in the memory address. The video data V-DATA modulated by the compensator 26 is transmitted to the data voltage generator 23. The modulated video data V-DATA is converted into the display data voltage by the data voltage generator 23 and is supplied to the first data line DL1.

As shown in FIG. 3B, the sensing unit 22 includes the DAC, thereby supplying a video data voltage V-DATA of the input image to the second data line DL2, and separately from the sensing unit 22, the reference voltage Vref may be applied to the subpixel 101 through the first data line DL1.

Figure 4A:
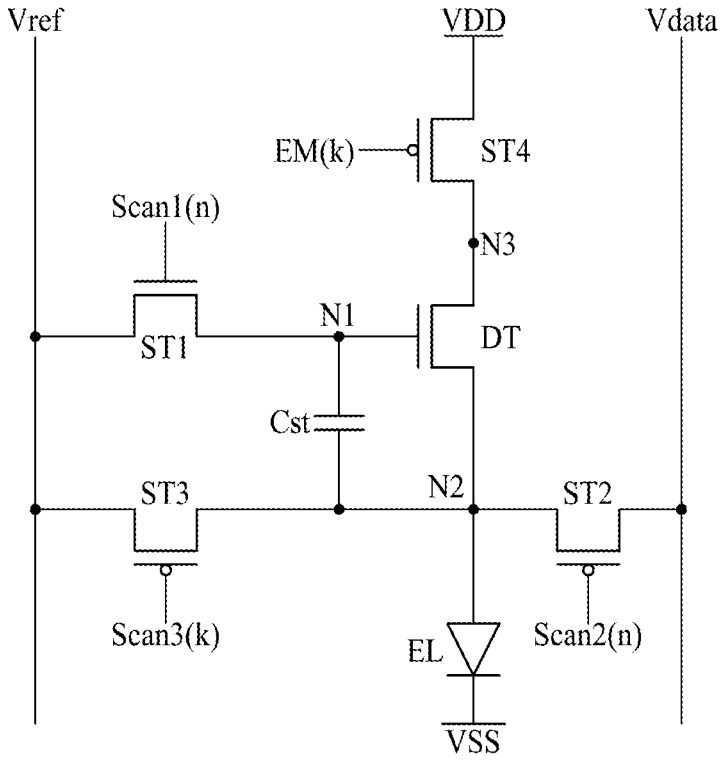
FIG. 4A is a pixel circuit view illustrating subpixels according to one aspect of the present disclosure.

FIG. 4A is a pixel circuit view illustrating subpixels according to one aspect of the present disclosure.

Referring to FIG. 4A, the pixel circuit according to one aspect of the present disclosure includes a light emitting diode EL, a driving transistor DT, a plurality of transistors ST1 to ST4, and a storage capacitor Cst. In this case, the driving transistor DT and the first transistor ST1 are implemented as N-type transistors, and the second transistor ST2, the third transistor ST3 and the fourth transistor ST4 are implemented as P-type transistors.

Each of the driving transistor DT and the first transistor ST1, which are N-type transistors, is implemented as an oxide transistor. The oxide transistor may be implemented with NMOS including an oxide semiconductor layer of which off current is low. The off current may be a leakage current which flows between a source and a drain of a transistor in an off state of the transistor. In a transistor of which off current is low, although the off state is long, since a leakage current is small, a luminance variation of the pixels may be minimized. Therefore, the driving transistor DT and the first transistor ST1, of which off state is long, may be implemented as N-type transistors including an oxide semiconductor, whereby a leakage current, which may occur in the driving transistor DT and the first transistor ST1, may be reduced.

The second transistor ST2, the third transistor ST3 and the fourth transistor ST4, which are P-type transistors, are implemented as polysilicon transistors. The polysilicon transistors may be implemented with PMOS including a low temperature poly silicon (LTPS) having high mobility.

Each of a plurality of stages constituting an emission driver and a third scan driver according to one aspect of the present disclosure may apply an emission signal and a third scan signal to two pixel rows that are odd and even numbered rows, and each of a plurality of stages constituting a first scan driver and a second scan driver may apply a first scan signal and a second scan signal to one pixel row. The first scan driver supplies a first scan signal, the second scan driver supplies a second scan signal, and the third scan driver supplies a third scan signal.

The pixel circuit of FIG. 4A is a subpixel in an nth pixel row, and an nth first scan signal Scan1($n$), an nth second scan signal Scan2($n$), and a $k^{th}$ third scan signal Scan3($k$), and a $k^{th}$ emission signal Em(k) are applied to the pixel circuit. Each of these signals Scan1($n$), Scan2($n$), Scan3($k$), and Em(k) swings between a logic high voltage and a logic low voltage, and controls on/off of each transistor. In this case, n is a natural number which is an even number, and k is a natural number which is ½.

The driving transistor DT is a driving device which adjusts a current flowing in the light emitting device EL in accordance with the gate-source voltage. The driving transistor DT includes a gate connected to a first node N1, a source connected to a second node N2, and a drain connected to a third node N3. The driving transistor DT may provide the driving current to the light emitting diode EL to allow the light emitting diode to emit light.

The first switch transistor ST1 is a switching transistor, and is turned on in accordance with the nth first scan signal Scan1($n$) to supply a reference voltage Vref to the first node N1, thereby initializing the gate of the driving transistor DT. The first transistor ST1 includes a gate connected to an nth first scan signal line to which the nth first scan signal Scan1($n$) is applied, a drain connected to a reference voltage line to which the reference voltage Vref is applied, and a source connected to the gate of the driving transistor DT through the first node N1.

The second transistor ST2 is turned on in accordance with the nth second scan signal Scan2($n$) during normal driving to supply a data voltage Vdata to the second node N2, and is turned on in accordance with the nth second scan signal Scan2($n$) during sensing to supply a sensing data voltage to the second node N2 and sense electrical characteristics of the driving device. Therefore, the second transistor ST2 may be referred to as a sensing transistor. The second transistor ST2 includes a gate connected to an nth second scan signal line to which the nth second scan signal Scan2($n$) is applied, a source connected to a data line to which the data voltage Vdata is applied, and a drain connected to the source of the driving transistor DT through the second node N2.

The third transistor ST3 is a switching transistor, and is turned on in accordance with a $k^{th}$ third scan signal Scan3($k$) to supply the reference voltage Vref to the second node N2, thereby resetting an anode of the light emitting diode EL. The third transistor ST3 includes a gate connected to a $k^{th}$ third scan signal line to which the kth third scan signal Scan3($k$) is applied, a source connected to the reference voltage line, and a drain connected to the source of the driving transistor DT through the second node N2.

The fourth transistor ST4 is turned on in accordance with the $k^{th}$ emission signal Em(k) to supply a high potential power voltage VDD to the third node N3. The $k^{th}$ emission signal Em(k) may be turned on for only a light emission period to prevent the light emitting diode EL from emitting light for a time period not the light emission period. Therefore, the fourth transistor ST4 may be referred to as an emission transistor. The fourth transistor ST4 includes a gate connected to a $k^{th}$ emission line to which the $k^{th}$ emission signal Em(k) is applied, a source connected to a high potential power voltage line to which the high potential power voltage VDD is applied, and a drain connected to the drain of the driving transistor DT through the third node N3.

The storage capacitor Cst includes one side electrode connected to the gate of the driving transistor DT through the first node N1 and the other side electrode connected to the source of the driving transistor DT through the second node N2. The storage capacitor Cst uniformly maintains the gate-source voltage of the driving transistor DT for a light emission period of the light emitting diode.

The light emitting diode EL includes an anode connected to the source of the driving transistor DT through the second node N2 and a cathode for providing a low potential power source VSS. The light emitting diode EL emits light in accordance with voltages applied to the anode and the cathode.

Figure 4B:
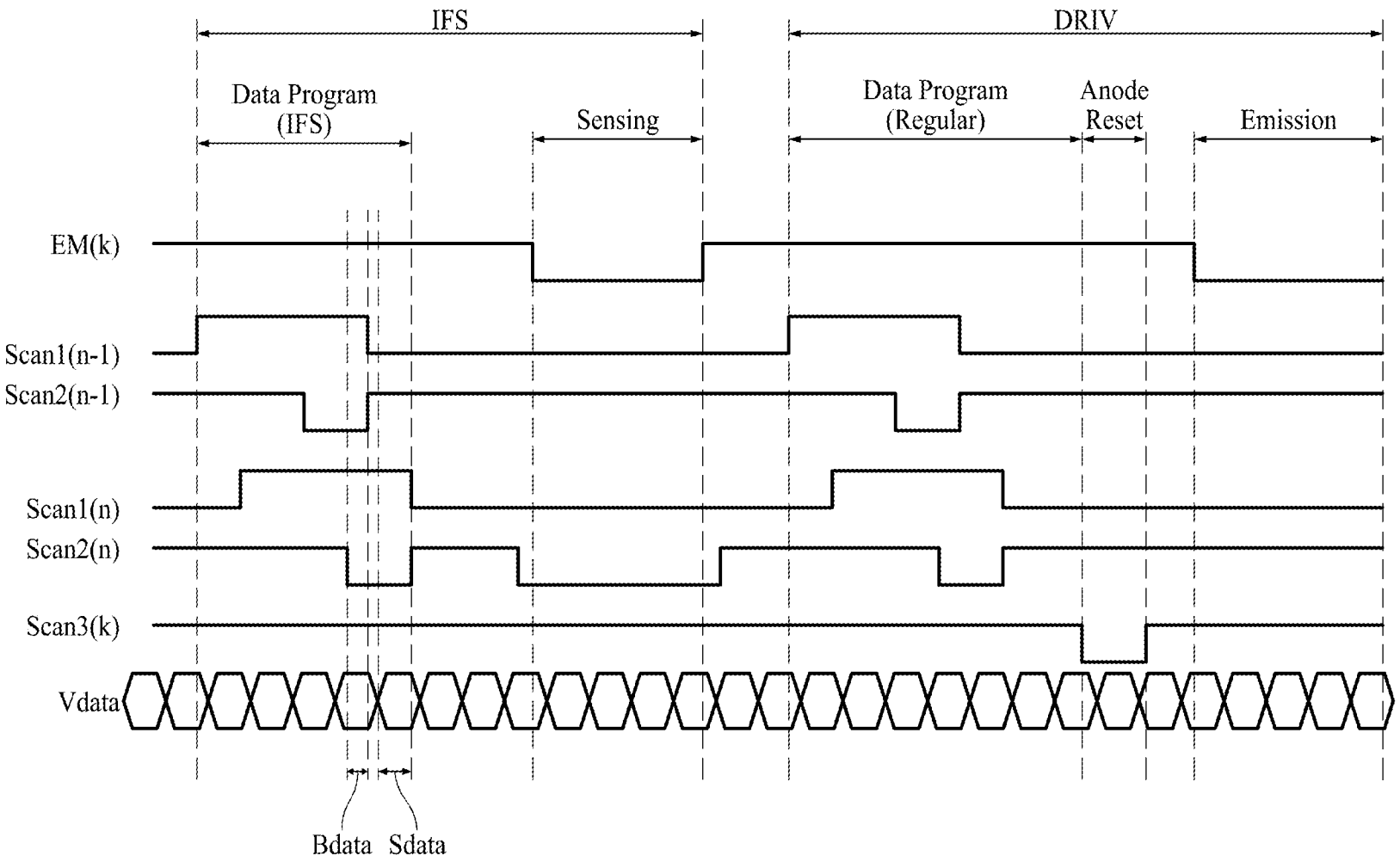
FIG. 4B is a waveform of FIG. 4A.

FIG. 4B is a waveform of FIG. 4A. As described with reference to FIG. 4A, a stage of the kth emission driver and a stage of the third scan driver provide signals to an $(n-1)^{th}$ pixel row and an nth pixel row. Therefore, a waveform of signals applied to the $(n-1)^{th}$ pixel row and the nth pixel row will be described with reference to FIG. 4B. A case that the (n−1)th pixel row is an odd numbered pixel row and the nth pixel row is an even numbered pixel row will be described as an example.

The pixel circuit to be sensed in accordance with one aspect of the present disclosure has an in frame sensing period (IFS) prior to a normal driving period DRIV. Hereinafter, an operation of the driving period DRIV will be described and then followed by the in frame sensing period (IFS).

Referring to FIG. 4B, as the (n−1)th first scan signal Scan1(*n*−1) is shifted to a gate on voltage, a data program period Data Program (Regular) for driving starts. For the data program period Data Program(Regular) for driving, the first transistor ST1 is turned on by the gate on voltage of the (n−1)th first scan signal Scan1(*n*−1), and thus the gate of the driving transistor DT is reset to the reference voltage Vref. Subsequently, as the $(n-1)^{th}$ second scan signal Scan2(*n*−1) is shifted to the gate on voltage, the second transistor ST2 is turned on. The second transistor ST2 which is turned on applies the data voltage Vdata to the second node N2. Therefore, one side electrode of the storage capacitor Cst is charged with the reference voltage Vref, and its other side electrode is charged with the data voltage Vdata. After charging the one side electrode and the other side electrode of the storage capacitor Cst, the first transistor ST1 and the second transistor ST2 are shifted to gate off voltages.

As the $k^{th}$ third scan signal Scan3(*k*) is shifted to the gate on voltage, an anode reset period starts. For the anode reset period, the third transistor ST3 is turned on to reset the anode of the light emitting diode EL to the reference voltage Vref. Therefore, as a voltage of the other side electrode of the storage capacitor Cst connected to the anode of the light emitting diode EL is shifted from the data voltage Vdata to the reference voltage Vref, a voltage of one side electrode of the storage capacitor Cst is shifted as much as a difference between the reference voltage Vref and the data voltage Vdata by coupling of the capacitor.

For the data program period for driving and the anode reset period, the $k^{th}$ emission signal Em(k) maintains the gate off voltage. For the light emission period, the $k^{th}$ emission signal Em(k) is shifted to the gate on voltage and thus provides the high potential power voltage VDD to the drain of the driving transistor DT. Therefore, for the light emission period, the driving transistor DT is turned on and thus provides the driving current to the anode of the light emitting diode EL.

As described above, the emission driver provides an emission signal to two pixel rows. Therefore, the nth pixel row which is the even numbered row performs a data program with a time difference before the $(n-1)^{th}$ pixel row which is the odd numbered row starts the data program.

The $(n-1)^{th}$ second scan signal Scan2(*n*−1) and the nth second scan signal Scan2(*n*) maintain the gate on voltage for 2-horizontal (2H) period. The $(n-1)^{th}$ first scan signal Scan1(*n*−1) and the nth first scan signal Scan1(*n*) maintain the gate on voltage for 2-horizontal (2H) period. The nth first scan signal Scan1(*n*) is shifted from the (n−1)th first scan signal Scan1(*n*−1) as much as a time period shorter than 1-horizontal (1H) period.

The operation of the in frame sensing period (IFS) of the pixel circuit included in the nth pixel row according to one aspect of the present disclosure will be described. Referring to FIG. 4B, the in frame sensing period (IFS) may include a data program period Data Program(IFS) for sensing and a sensing period Sensing.

For the data program period Data Program (Regular) for driving of the driving period DRIV, waveforms of the first scan signals Scan1(*n*−1) and Scan1(*n*) and the second scan signals Scan2(*n*−1) and Scan2(*n*) are equally applied to the data program period Data Program(IFS) for sensing of the in frame sensing period (IFS). However, the data voltage input for the data program period Data Program (IFS) for sensing is different from the data voltage input for the data program period Data Program (Regular) for driving.

For the data program period Data Program (IFS) for sensing, the first transistor ST1 and the second transistor ST2 are turned on by the nth first scan signal Scan1(*n*) and the nth second scan signal Scan2(*n*), whereby one side electrode of the storage capacitor Cst is charged with the reference voltage Vref and its other side electrode is charged with the data voltage Vdata. The first transistor ST1 and the second transistor ST2 are turned off at the same time.

Before the first transistor ST1 and the second transistor ST2 of the pixel circuit included in the nth pixel row are turned on, the first transistor ST1 and the second transistor ST2 of the pixel circuit included in the $(n-1)^{th}$ pixel row are turned on. The time periods when the first transistor ST1 and the second transistor ST2 included in the pixel circuits of the $(n-1)^{th}$ and nth pixel rows are turned on are overlapped with each other.

The sensing data program period is followed by the sensing period Sensing. For the sensing period Sensing, the $k^{th}$ emission signal Em(k) for sensing the pixel circuit of the nth pixel row is the gate on voltage. In this case, since the pixel circuit of the $(n-1)^{th}$ pixel row emits light, the pixel circuit of the $(n-1)^{th}$ pixel row should not emit light.

To this end, the data voltage input for the data program period for sensing of the pixel circuit of the nth pixel row may be adjusted. In more detail, for a time period when the nth second scan signal Scan2(*n*) is shifted to the gate on voltage and the $(n-1)^{th}$ second scan signal Scan2(*n*−1) is shifted from the gate on voltage to the gate off voltage, a black data voltage Bdata is provided to the data voltage Vdata. The black data voltage Bdata is a data voltage that may display a black screen on the display panel, and allows the (n−1)th pixel row not to emit light. The time period when the black data voltage Bdata is provided may be one horizontal (1 H) period, and the corresponding time period corresponds to a time period when a voltage is determined to allow the light emitting diode EL to emit light. The black data voltage Bdata is provided through the second transistor ST2.

Subsequently, for a time period before the $(n-1)^{th}$ first scan signal Scan1(*n*−1) and the $(n-1)^{th}$ second scan signal Scan2(*n*−1) are shifted to the gate on voltages and the nth first scan signal Scan1(*n*) and the nth second scan signal Scan2(*n*) are shifted to the gate off voltages, the sensing data voltage Sdata is provided to the data voltage Vdata. The sensing data voltage Sdata is a voltage provided to sense electrical characteristics of the pixel circuit of the $(n)^{th}$ pixel row. The time period when the sensing data voltage Sdata corresponds to one horizontal (1H) period. As the sensing data voltage Sdata is provided for the corresponding period, the second transistor ST2 applies the sensing data voltage Sdata to the source of the driving transistor DT. In this case, the electrical characteristics of the pixel circuit may be the amount of the driving current provided from the driving device, and the amount of the driving current may be sensed to determine the state of the driving device, whereby compensation may be performed.

As described above, if the even numbered pixel row is sensed, the black data voltage Bdata is applied to the data voltage Vdata for the sensing data program period Data Program (IFS) and then the sensing data voltage Sdata is applied thereto. On the contrary, if the odd numbered pixel row is sensed, the black data voltage Bdata is applied after the sensing data voltage Sdata is applied, whereby the odd numbered pixel row may not emit light.

Subsequently to the sensing data program period Data Program(IFS), as the $k^{th}$ emission signal Em(k) is shifted to the gate on voltage, the sensing period Sensing starts. For the sensing period Sensing, the emission signal Em(k) maintains the gate on voltage, and the second scan driver for providing the second scan signal to sense electrical characteristics of the driving device through the second transistor ST2 provides the gate on voltage to the nth second scan signal Scan2(*n*). Therefore, the fourth transistor ST4, the driving transistor DT, and the second transistor ST2 are turned on to sense electrical characteristics of the driving device through the data line (or sensing line).

For the in frame sensing period (IFS), the $k^{th}$ third scan signal Scan3(*k*) which is not included in a process of applying and sensing data maintains the gate off voltage.

For the sensing data program period Data Program(IFS), the first transistor ST1 is turned on to apply the reference voltage Vref to the first node N1, and the second transistor ST2 is turned on to apply the sensing data voltage Sdata to the second node N2. Therefore, the gate-source voltage Vgs of the driving transistor DT is stored in the storage capacitor Cst. Subsequently, as the first transistor ST1 and the second transistor ST2 are turned off, the gate-source voltage Vgs of the driving transistor DT is maintained. Then, for the sensing period Sensing, the second transistor ST2 and the fourth transistor ST4 are turned on, and thus a current path is formed from the high potential power voltage line to the data line. The amount of a current flowing through the data line along the current path is sensed to determine electrical characteristics of the driving transistor DT. As the amount of the current flowing through the data line for the sensing period Sensing, the data voltage Vdata to be applied through the data line may be determined for the data program period Data Program (Regular) for normal driving. For example, if the current flowing through the data line is small for the sensing period due to deterioration of electrical characteristics of the driving transistor DT, a data voltage lower than the original data voltage is applied for the data program period Data Program (Regular). Therefore, as the electrical characteristics of the driving transistor DT are deteriorated, the higher gate-source voltage Vgs is applied, whereby the current flowing to the light emitting diode EL may be maintained uniformly.

Although the driving period DRIV and the in frame sensing period (IFS) of the pixel circuits of the nth pixel row have been described above, sequential driving may be performed in the pixel row subsequent to the driving period DRVI after the in frame sensing period (IFS) in the pixel row to be sensed.

As described above, the nth second scan signal and the $k^{th}$ emission signal should be gate on voltages for the period not the driving period DRIV of the pixel circuit, thereby sensing the nth pixel row. Therefore, the second scan driver for providing the second scan signal and the emission driver for providing the emission signal should selectively output a random gate signal to a specific pixel row. To this end, the second scan driver may be implemented to adjust a clock signal input thereto, and the emission driver may be implemented to include separate controllers which can control the output of the emission driver.

Hereinafter, the second scan driver and the emission driver will be described. The second scan driver may be referred to as a sensing scan driver.

Figure 5A:
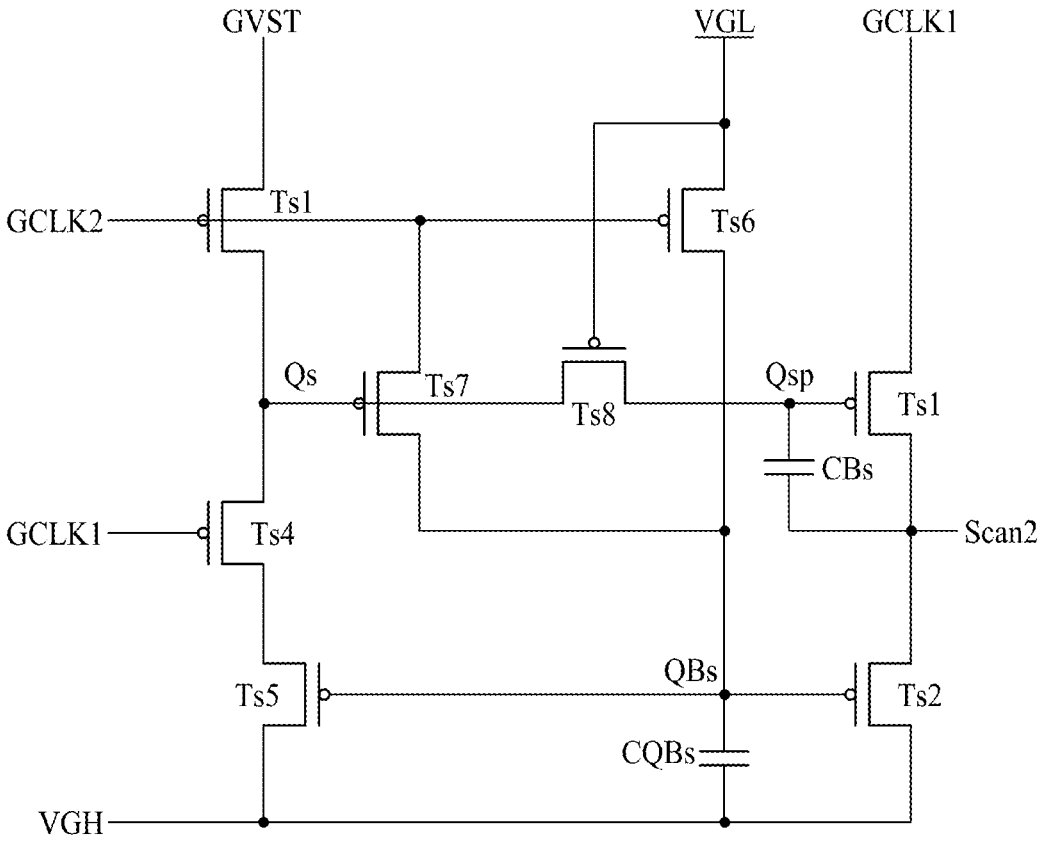
FIG. 5A is a circuit view illustrating a sensing scan driver according to one aspect of the present disclosure.
Figure 5B:
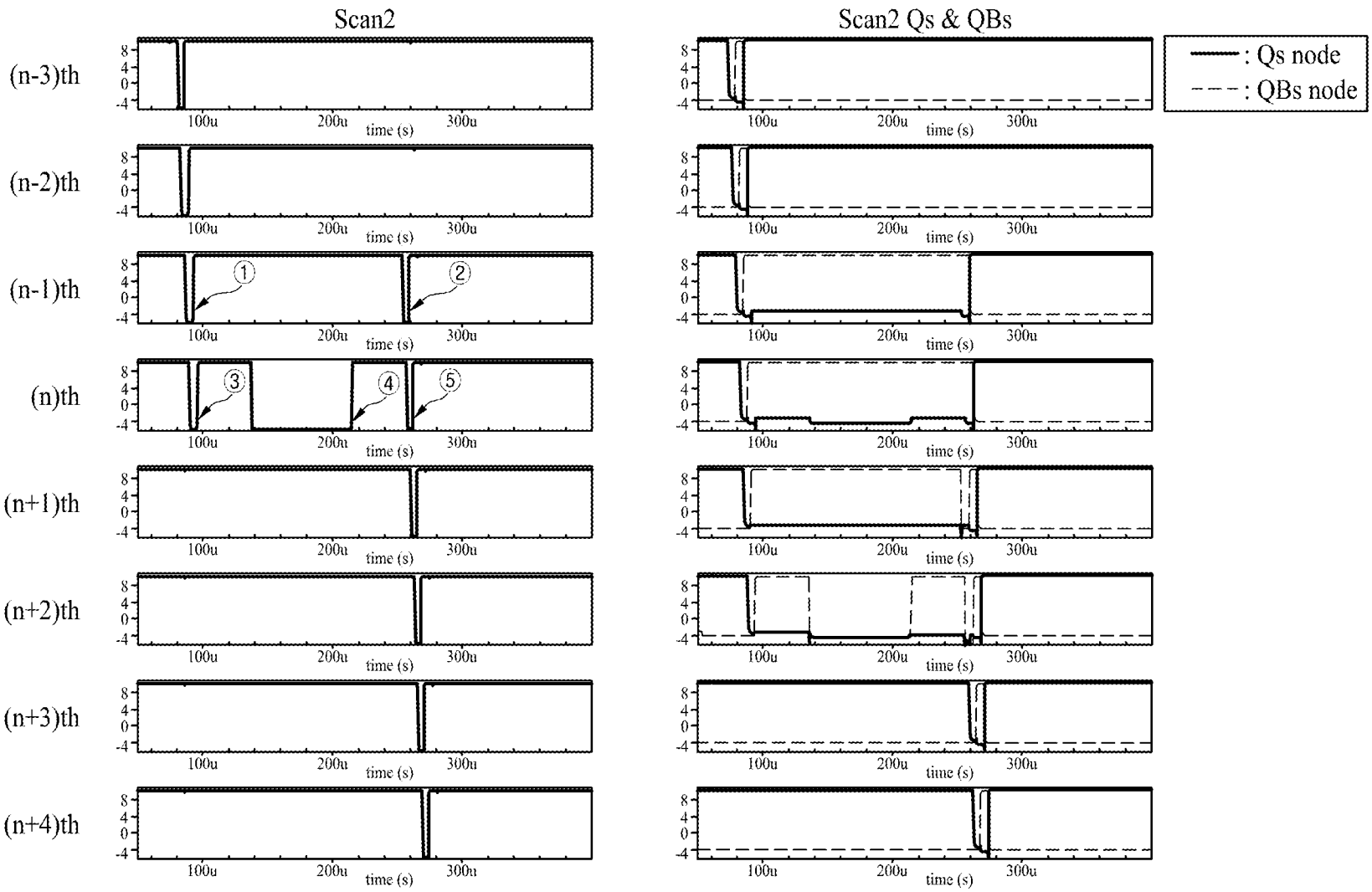
FIG. 5B is a waveform illustrating a sensing scan driver according to one aspect of the present disclosure.

FIG. 5A is a circuit view illustrating a sensing scan driver according to one aspect of the present disclosure, and FIG. 5B is a waveform illustrating a sensing scan driver according to one aspect of the present disclosure. Also, FIG. 5B is a waveform when the nth pixel row is sensed.

Referring to FIGS. 5A and 5B, the sensing scan driver according to one aspect of the present disclosure is implemented as eight (8) transistors and two (2) capacitors. The transistors are all p type transistors. Gates of the first scan transistor Ts1 and the second transistor Ts2 are respectively connected to Qsp node and QBs node. The QBs node discharges the gate of the second scan transistor Ts2. In this case, discharging of the transistors constituting the sensing scan driver means the gate on voltage, and charging thereof means the gate off voltage. Therefore, the first scan transistor Ts1 may be referred to as a pull-down transistor, and the second scan transistor Ts2 may be referred to as a pull-up transistor.

The first scan transistor Ts1 or the second scan transistor Ts2 is turned on in accordance with the Qsp node and the QBs node and thus a first gate clock GCLK1 or a gate off voltage VGH is output to the nth second scan signal Scan2 (*n*). Since the second scan transistor ST2 of the pixel circuit to which an output signal of the sensing scan driver is input is a p type transistor, the second scan transistor ST2 is turned on in accordance with the gate on voltage. In this case, the second scan signal may be referred to as a sensing signal, and the sensing scan driver is operated by being synchronized with the first controller and the second controller, which will be described later.

The first gate clock GCLK1 may be adjusted to turn on the second transistor ST2 of the pixel circuit by providing a random signal to a gate line in a specific pixel row.

Clock signals such as the second gate clock GCLK2 as well as the first gate clock GCLK1 are generated by the data driver 110. The data driver 110 adjusts the waveform of the nth second scan signal Scan2(*n*) by controlling the first gate clock GCLK1 and the second gate clock GCLK2 to correspond to a pixel row to be sensed. As described above, since each of a plurality of stages constituting the emission driver of the present disclosure applies an emission signal to two pixel rows, the $(n-1)^{th}$ emission signal is turned on together with the nth emission signal when the nth pixel row is to be sensed. Therefore, the data driver 110 should apply the black data voltage to the $(n-1)^{th}$ pixel row to prevent the $(n-1)^{th}$ pixel row from emitting light.

Referring to the second scan signal Scan2 of FIG. 5B, the $(n-1)^{th}$ second scan driver outputs a first output signal □ to apply the black data voltage, and outputs a second output signal □ to apply the data voltage for driving. The nth second scan driver outputs a first output signal □ to apply the sensing data voltage, outputs a second output signal □ for sensing, and outputs a third output signal □ to apply the data voltage for driving. From the $(n+1)^{th}$ pixel row, the second scan driver outputs only an output signal for applying the data voltage for driving. In this case, for example, the gate on voltage is −4V, and the gate off voltage is 9V.

Figure 6:
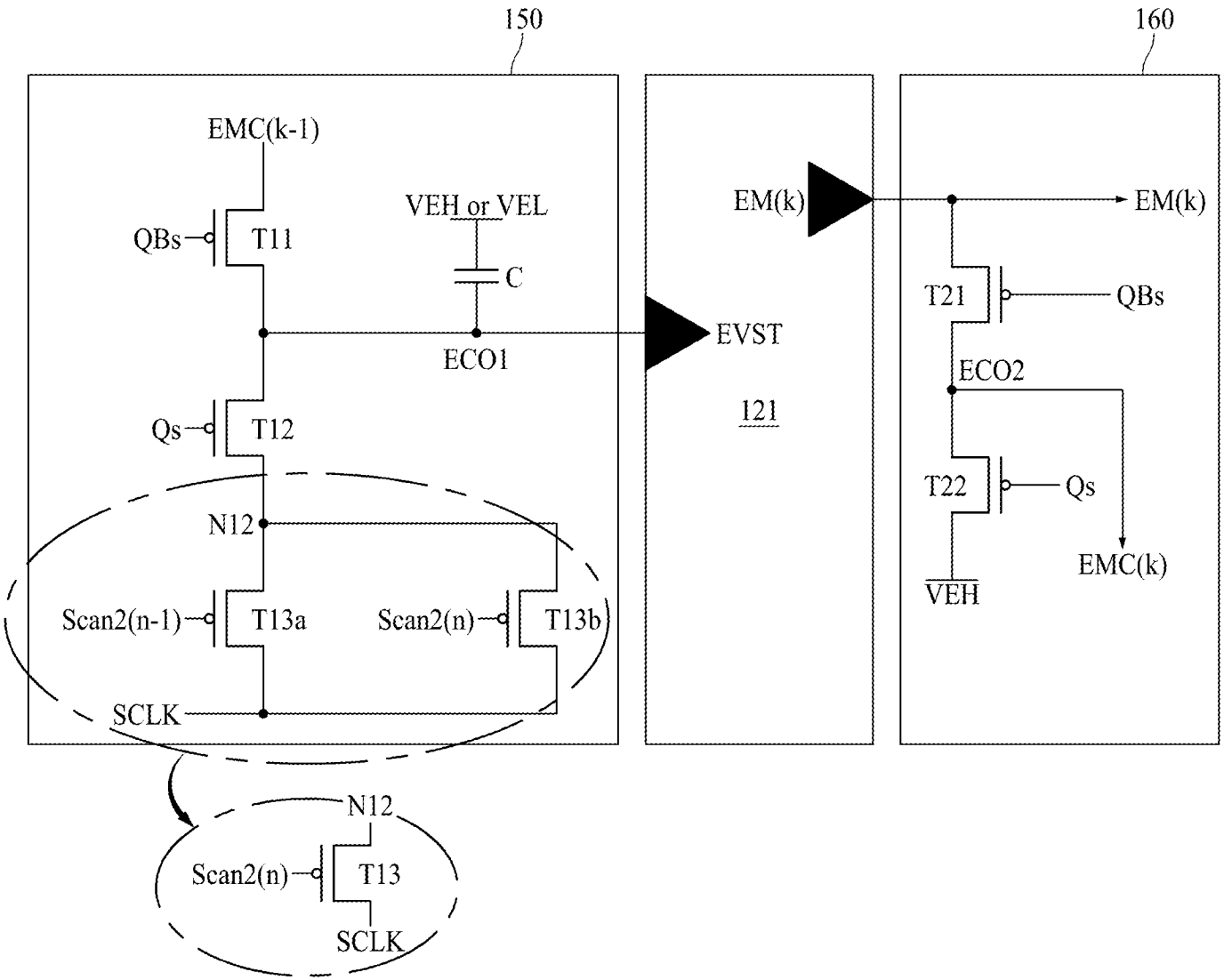
FIG. 6 is a view illustrating an emission driver for in frame sensing (IFS) according to one aspect of the present disclosure.
Figure 7:
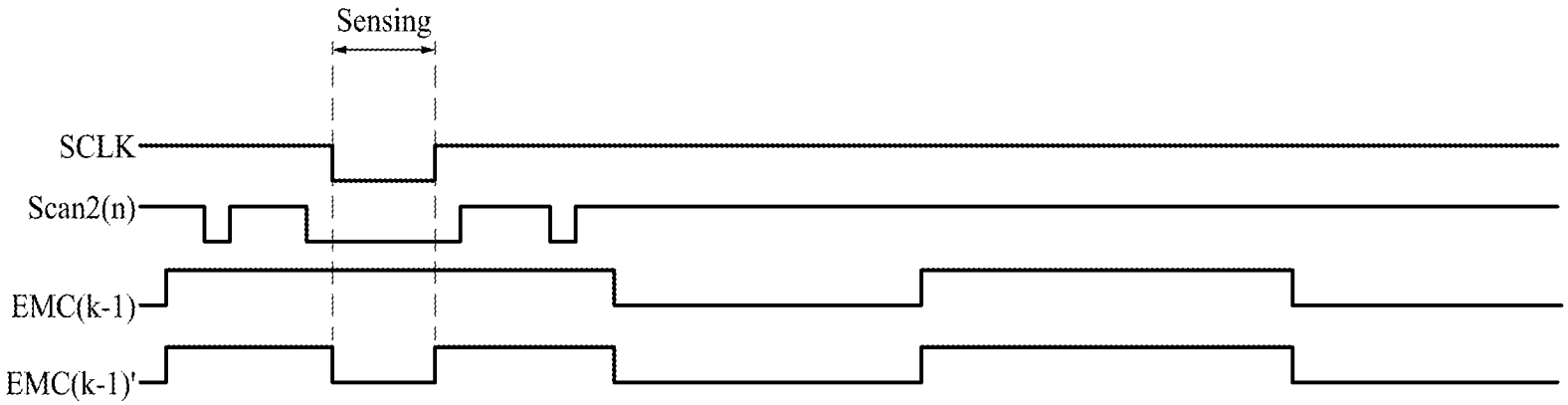
FIG. 7 is a waveform illustrating a first controller according to one aspect of the present disclosure.
Figure 8:
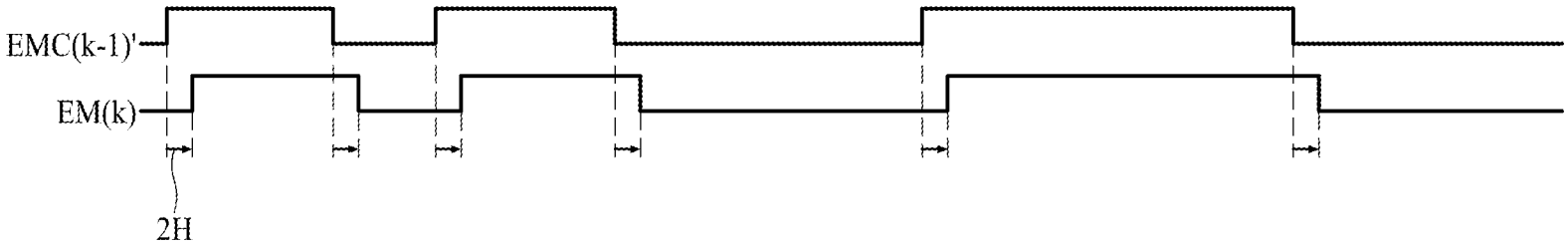
FIG. 8 is a waveform illustrating an emission driver according to one aspect of the present disclosure.
Figure 9:
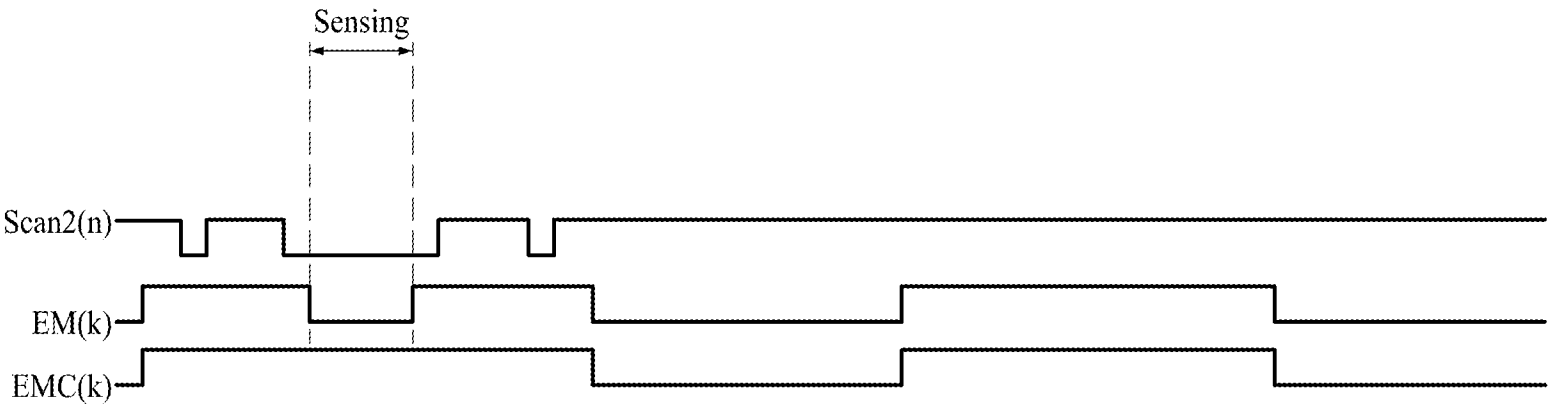
FIG. 9 is a waveform illustrating a second controller according to one aspect of the present disclosure.

FIG. 6 is a view illustrating an emission driver for IFS according to one aspect of the present disclosure. In order to sense the nth pixel row, the gate driver includes an emission driver 121, a first controller 150 for providing an input signal to the emission driver 121, and a second controller 160 for adjusting an output signal of the emission driver 121. In this case, the first controller 150, the emission driver 121 and the second controller 160 are defined as an emission driver for IFS. FIG. 7 is a waveform illustrating the first controller 150 according to one aspect of the present disclosure, FIG. 8 is a waveform illustrating the emission driver 121 according to one aspect of the present disclosure, and FIG. 9 is a waveform illustrating the second controller 160 according to one aspect of the present disclosure. Hereinafter, description will be given with reference to FIGS. 6 to 9.

Each of the emission driver 121, the first controller 150 and the second controller 160 includes a plurality of stages. Since the plurality of stages constituting the emission driver 121 apply an emission signal to two pixel rows, the number of the plurality of stages constituting the emission driver 121 corresponds to a half of the number of pixel rows of the display panel.

As described above, the $k^{th}$ emission signal Em(k) for sensing the nth pixel row should be a gate on voltage for the sensing period Sensing of the in frame sensing period (IFS). The gate on voltage of the $k^{th}$ emission signal Em(k) generated for the sensing period Sensing is a voltage randomly generated for sensing. Therefore, the first controller 150 for generating a signal for sensing the nth pixel row may be arranged, whereby the output signal output from the first controller 150 may be applied to the emission driver 150 as an input signal. The emission driver 121 shifts the signal received from the first controller 150 and outputs the shifted signal. The output signal shifted from the emission driver 121 is input to the second controller 160. The second controller 160 provides the output signal output through the emission driver 121 to the nth pixel row as it is, and shifts the output signal output through the emission driver 121 in the $(n+1)^{th}$ pixel row and then provides the shifted signal to the $(k+1)^{th}$ stage of the first controller. Since the output signal output from the emission driver 121 is a signal randomly generated for sensing of the nth pixel row, the signal randomly generated through the second controller 160 is re-shifted to provide the signal for normal driving of the $(n+1)^{th}$ pixel row. In this case, the signal output from the $k^{th}$ stage of the second controller 160 and input to the $(k+1)^{th}$ stage of the first controller is defined as a carry signal.

Referring to FIGS. 6, 7 and 5B, the first controller 150 uses a sensing clock SCLK, the nth second scan signal Scan2(*n*) of the second scan driver, and voltages of Qs node and QBs node of the second scan driver to generate the gate on voltage. The first controller 150 includes an eleventh transistor T11, a twelfth transistor T12, a 13A-th transistor T13A, a 13B-th transistor T13B, and a capacitor C.

The eleventh transistor T11 is controlled by the QBs node to apply the $(k-1)^{th}$ emission carry signal EMC(k−1) to an output node ECO1 of the first controller 150.

The capacitor C includes one side terminal connected to the output node ECO1 of the first controller 150 and the other side terminal connected to a line to which an emission high voltage VEH or an emission low voltage VEL is provided. The capacitor C stabilizes the voltage of the output node ECO1 of the first controller 150. Referring to FIG. 5B, pixel rows having variable waveforms for the in frame sensing period (IFS) for sensing the nth pixel row are the $(n-1)^{th}$, $(n)^{th}$, $(n+1)^{th}$ and $(n+2)^{th}$ pixel rows. Referring to waveforms of the nth second scan signal Scan2(*n*) and the Qs node and the QBs node of the second scan driver in the corresponding pixel rows, the Qs node corresponds to the gate on voltage, the QBs node corresponds to the gate off voltage, and the nth second scan signal Scan(n) corresponds to the gate off voltage. This is based on the first gate clock GCLK1 modified for sensing, and the output node ECO1 of the first controller 150 for the corresponding period is a floating state. Therefore, the capacitor C may be connected to the output node ECO1 of the first controller 150 to stabilize the output node ECO1 of the first controller 150.

The twelfth transistor T12 is controlled by the Qs node and applies a voltage of a twelfth node N12 to the output node ECO1 of the first controller 150.

The 13A-th transistor T13A and the 13B-th transistor T13B are controlled by their respective signals different from each other and connected with each other in parallel. The 13A-th transistor T13A is controlled by the $(n-1)^{th}$ second scan signal Scan2(*n*−1) which is the odd numbered pixel row to apply the sensing clock SCLK to the twelfth node N12, and the 13B-th transistor T13B is controlled by the nth second scan signal Scan2(*n*) which is the even numbered pixel row to apply the sensing clock SCLK to the twelfth node N12. For example, if the emission driver provides an emission signal to one pixel row, the 13A-th transistor T13A and the 13B-th transistor T13B may be implemented as one transistor which is the thirteenth transistor T13. The thirteenth transistor T13 is controlled by the nth second scan signal Scan2(*n*) to apply the sensing clock SCLK to the twelfth node N12.

The $(k-1)^{th}$ emission carry signal EMC(k−1) is a carry signal provided from the second controller which provides an emission signal to a pixel row for normal driving not a pixel row for sensing. On the other hand, the sensing clock SCLK is generated from the data driver 110 as a clock signal for selecting a pixel row for sensing, in the same manner as a gate clock. The emission carry signal EMC(k−1) is applied to the output node ECO1 of the first controller 150 through the eleventh transistor T11, and the sensing clock SCLK is applied to the output node ECO1 of the first controller 150 by the 13A-th transistor T13A or the 13B-th transistor T13B, and the twelfth transistor T12.

For the sensing period Sensing of the in frame sensing period (IFS), since the sensing clock SCLK is the gate on voltage and the nth second scan signal Scan2(*n*) is also the gate on voltage, the 13B-th transistor T13B is turned to apply the gate on voltage of the sensing clock SCLK to the twelfth node N12. In this case, since the $(n-1)^{th}$ second scan signal Scan2(*n*−1) is a gate off voltage, the 13A-th transistor T13A is turned off. Since the gate on voltage is applied to the Qs node, the twelfth transistor T12 is turned on to apply the gate on voltage which is the voltage of the twelfth node N12 to the output node ECO1 of the first controller 150. Since the gate off voltage is applied to the QBs node while the gate on voltage is being applied to the Qs node, the eleventh transistor T11 is turned off. Therefore, the first controller 150 applies the sensing clock SCLK of the gate on voltage to the output node ECO1 for the sensing period Sensing. That is, the first controller 150 outputs an emission carry signal EMC(k−1)' modified from the (k−1)th emission carry signal EMC(k−1) for the sensing period Sensing. In this case, the modified emission carry signal EM(k−1)' may be referred to as an output signal or a control signal of the first controller 150.

Referring to FIGS. 6 and 8, the control signal output from the first controller 150 is input to an emission start signal EVST of the emission driver 121. The emission driver 121 may be implemented as a shift register which can sequentially shift an emission signal. The emission driver 121 outputs the $k^{th}$ emission signal Em(k) by shifting the modified emission carry signal EMC(k−1)' output from the first controller 150. Since each of stages constituting the emission driver provides an emission signal to two pixel rows, the emission driver outputs the emission signal EM(k) by shifting the kth modified emission carry signal EMC(k−1)' for one 2 horizontal period (2H).

Referring to FIGS. 6, 9 and 5B, the $k^{th}$ emission signal EM(k) output from the emission driver 121 is provided to the emission line of the nth pixel row. The $k^{th}$ emission signal EM(k) is an emission signal modified to sense the nth pixel row, and the $(k+1)^{th}$ pixel row should perform normal driving not sensing. Therefore, the second controller 160 provides the emission signal re-shifted for normal driving to the $(k+1)^{th}$ stage of the emission driver that provides the emission signal to the $(n+1)^{th}$ pixel row. The second controller 160 outputs the $k^{th}$ emission carry signal EMC(k) provided to the $(k+1)^{th}$ stage of the emission driver by using the $k^{th}$ emission signal EM(k) as an input signal.

The second controller 160 uses the $k^{th}$ emission signal EM(k), and Qs node and QBs node of the second scan driver. The second controller 160 includes a 21st transistor T21 and a 22nd transistor T22. The 21st transistor T21 is controlled by the QBs node to apply the kth emission signal EM(k) to an output node ECO2 of the second controller 160. The 22nd transistor T22 is controlled by the Qs node to apply an emission high voltage VECH to the output node ECO2 of the second controller 160.

Since the nth second scan signal Scan2(*n*) and the $k^{th}$ emission signal EM(k) are emission low voltages for the sensing period Sensing for sensing the nth pixel row, the $k^{th}$ emission carry signal EMC(k) output from the second controller 160 should be an emission high voltage for the sensing period Sensing. In the second controller 160, since the Qs node turns on the first scan transistor Ts1 of FIG. 5 such that the $n^{th}$ second scan signal Scan2(*n*) may be the gate on voltage, the second controller 160 is implemented to control the 22nd transistor T22, thereby outputting the emission high voltage VEH. Therefore, the second controller 160 outputs the emission high voltage VEH when the nth second scan signal Scan(n) correspond to the gate on voltage, and outputs the kth emission signal EM(k) when the nth second scan signal Scan(n) corresponds to the gate off voltage. That is, the second controller 160 outputs the $k^{th}$ emission carry signal EMC(k) by re-shifting the kth emission signal EM(k) modified to the gate low voltage to the gate high voltage, whereby the pixel circuit of the $(n+1)^{th}$ pixel row may be driven normally.

Figure 10:
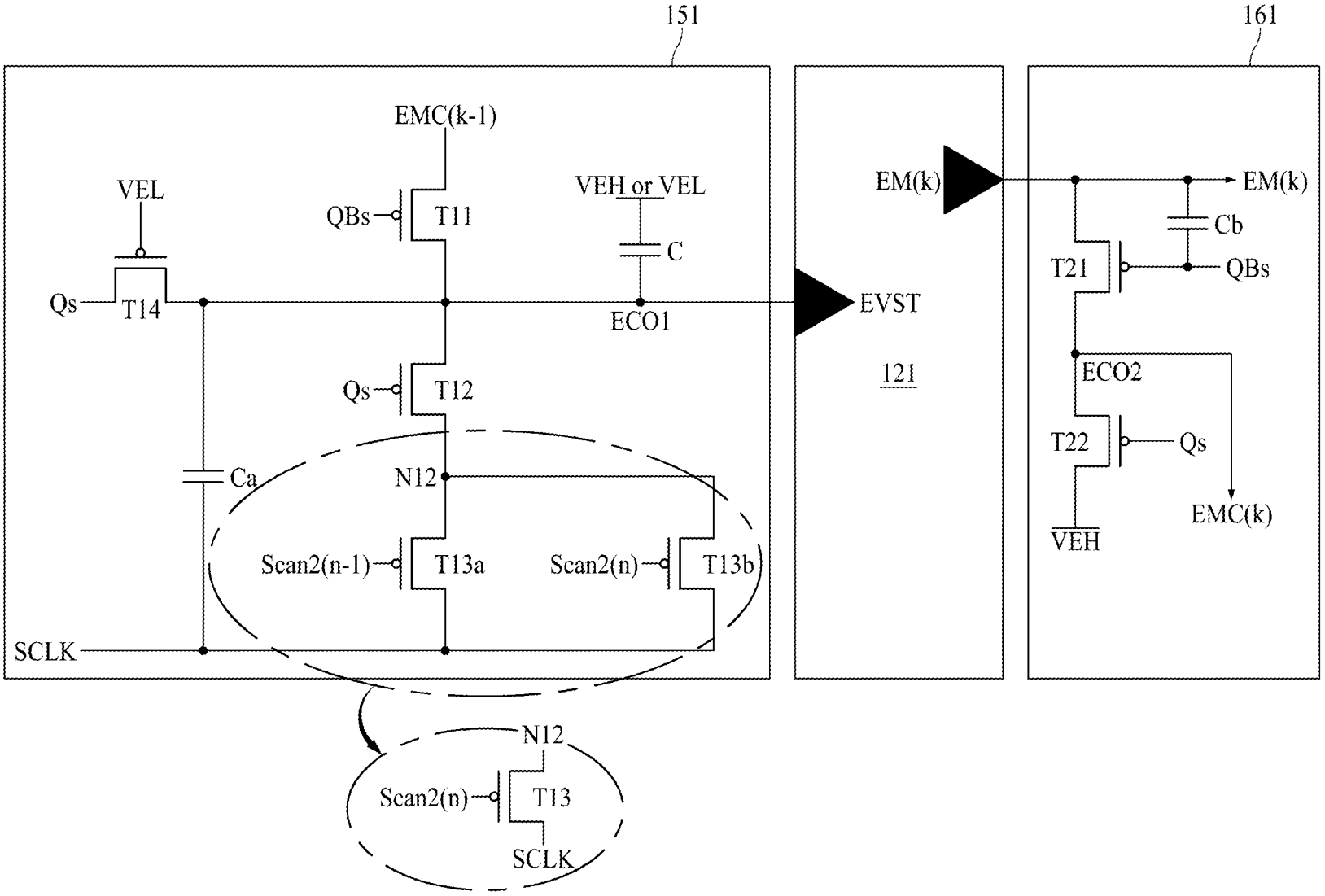
FIG. 10 is a view illustrating an emission driver for IFS according to another aspect of the present disclosure.

FIG. 10 is a view illustrating an emission driver for IFS according to another aspect of the present disclosure.

As described with reference to FIG. 1, the gate driver 120 may be arranged at both sides of the display panel 100 in a GIP type. Likewise, the emission driver 121 may be arranged at both sides of the display panel 100 in a GIP type to transfer an emission signal to each of an odd numbered pixel row and an even numbered pixel row. In this case, there may be a difference between a waveform of an emission signal provided to the (n−1)th pixel row which is the odd numbered pixel row and a waveform of an emission signal provided to the nth pixel row which is the even numbered pixel row. This is because that the first controller 151 constituting the emission driver for IFS is controlled by Qs node and QBs node of the second scan driver and the output signal of the second scan driver. Although signals of the Qs node and the QBs node may be provided from the second scan driver at one side, the output signal of the second scan driver may be provided from both sides. There may be a difference between the signal provided from one side and the signal provided from both sides in view of timing. Since the driving transistor included in the pixel circuit is a sensitive element, electrical characteristics of the driving transistor may be varied depending on a sensing timing. Therefore, the first controller 151 according to another aspect of the present disclosure may be implemented to make sure of uniformity in emission signal waveforms. The signals and nodes provided from one side or both sides of the second scan driver to the first controller 151 are limited to the aforementioned description. The signals and nodes may be modified depending on arrangement of the stages of the second scan driver, and a difference between signals input to the first controller 151 may be generated even by another design structure.

The first controller 151 according to another aspect of the present disclosure indicates that a 14th transistor T14 and a first sub capacitor Ca are added to the first controller 150 of FIG. 6 in order to make sure of uniformity of emission signal waveforms. Therefore, description of elements of the first controller 151 according to another aspect of the present disclosure, which are repeated with those of the first controller 150 of FIG. 6, will be omitted or briefly made.

The first controller 151 includes a 14th transistor T14 and a first sub capacitor Ca as well as an eleventh transistor T11, a twelfth transistor T12, a 13A-th transistor T13A, a 13B-th transistor T13B, and a capacitor C.

The 14th transistor T14 is controlled by the emission low voltage VEL to apply the voltage of the Qs node to the output node ECO1 of the first controller 151. The first sub capacitor Ca includes one side terminal connected to the output node ECO1 of the first controller 151 and the other side terminal connected to the sensing clock SLCK. As the 14th transistor T14 controlled by the emission low voltage VEL is added to the output node ECO1 of the first controller 151, the voltage of the Qs node may be applied to the output node ECO1 of the first controller 151 to uniformly make sure of a waveform of the output node ECO1 of the first controller 151 due to a timing difference between the nth second scan signal Scan2(*n*) and the Qs node. One side terminal of the first sub capacitor Ca is connected to the output node ECO1 of the first controller 151, and its other side terminal is connected to the sensing clock input line to which the sensing clock SCLK is input. The first controller 151 according to another aspect of the present disclosure has resistance components of the twelfth transistor T12, which are varied depending on whether the pixel row for sensing is an odd numbered row or an even numbered row. For example, if the odd numbered pixel row is sensed, a gate of the twelfth transistor T12 is a voltage previously charged during driving of a previous pixel row. If the even numbered pixel row is sensed, the gate of the twelfth transistor T12 is subjected to boot strap by a boot strap capacitor CBs of the scan driver and thus becomes a gate low voltage. Therefore, since a waveform of the emission signal output in accordance with a pixel row for sensing may be varied, the first sub capacitor Ca may be arranged to uniformly maintain the waveform of the emission signal output using a coupling effect of the capacitor when the sensing clock SCLK is a logic low voltage.

The $k^{th}$ emission signal EM(k) output from the emission driver 121 is input to the (k+1)th stage of the first controller through the second controller 161. In detail, the kth emission signal EM(k) is input to next stage of the first controller after passing through the 21st transistor T21 controlled by the QBs node or the 22nd transistor T22 controlled by the Qs node. A threshold voltage value shifted by degradation of the 21st transistor T21 or the 22nd transistor T22 is reflected in the output signal provided through the 21st transistor T21 or the 22nd transistor T22. For this reason, it may be unfavorable for a negative shift margin for the threshold voltage of the 21st transistor T21 or the 22nd transistor T22.

The second controller 161 according to another aspect of the present disclosure indicates that a second sub capacitor Cb is added to the second controller 160 of FIG. 60 in order to make sure of a shift margin of the threshold voltage of the 21st transistor T21 or the 22nd transistor T22. Therefore, description of elements of the second controller 161 according to another aspect of the present disclosure, which are repeated with those of the second controller 160 of FIG. 6, will be omitted or briefly made.

The second controller 161 further includes a second sub capacitor Cb as well as a 21st transistor T21 and a 22nd transistor T22. One side terminal of the second sub capacitor Cb is connected to a node from which the $k^{th}$ emission signal EM(k) is output, and its other side terminal is connected to the QBs node. The $k^{th}$ emission carry signal EMC(k) means that the kth emission signal EM(k) has passed through the 21st transistor T21. When the $k^{th}$ emission signal EM(k) and the QBs node correspond to gate on voltages, the $k^{th}$ emission signal EMC(k) is output as a signal equivalent to a difference between the QBs node and the threshold voltage of the 21st transistor T21 without becoming a gate on voltage. In this case, the threshold voltage of the 21st transistor T21 is enhanced, whereby a defect may be caused. Therefore, as the second sub capacitor Cb is connected between the node from which the $k^{th}$ emission signal EM(k) is output and the QBs node, the gate voltage of the 21st transistor T21 may be lowered using a coupling effect of the capacitor, which occurs when the $k^{th}$ emission signal EM(k) is a gate on voltage, thereby making sure of the threshold voltage margin of the 21st transistor T21.

The first controller according to another aspect of the present disclosure further includes a transistor and a first sub capacitor, which are connected to the output node of the first controller, and the second controller further includes a second sub capacitor connected to the output node of the second controller, whereby stability and reliability of the emission driver for IFS may be improved.

Figure 11:
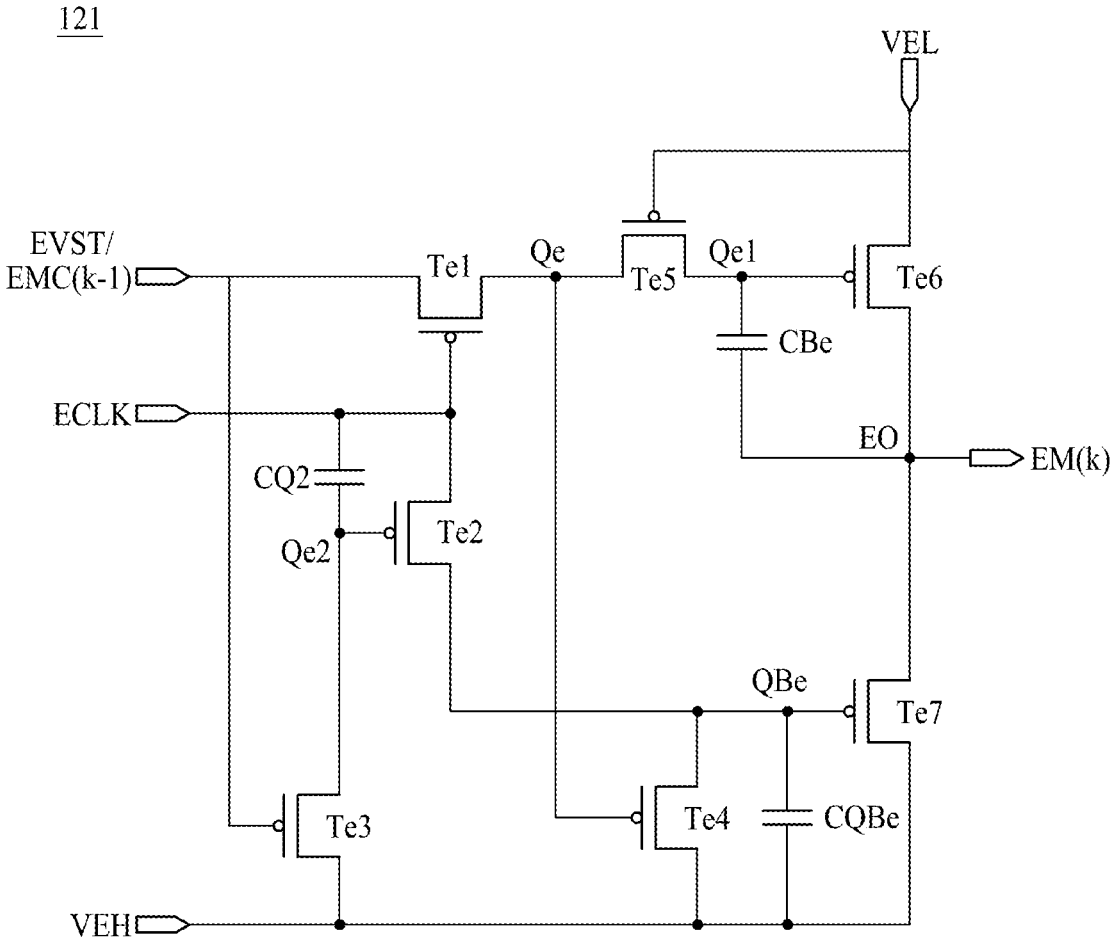
FIG. 11 is a circuit view illustrating an emission driver according to one aspect of the present disclosure.

FIG. 11 is a circuit view illustrating an emission driver according to one aspect of the present disclosure. In detail, FIG. 11 is a circuit view illustrating a $k^{th}$ stage for providing an emission signal to an nth pixel row, among a plurality of stages constituting an emission driver.

Referring to FIG. 11, the emission driver 121 outputs an emission signal EM(k) of an emission high voltage VEH for a time period when Qe node is deactivated to a gate off voltage and QBe node is activated to a gate on voltage. The emission driver 121 outputs an emission signal EM(k) of an emission low voltage VEL for a time period when Qe node is activated to a gate on voltage and QBe node is deactivated to a gate off voltage. In other words, the emission driver 121 outputs the emission signal EM(k) of the emission low voltage VEL when Qe1 node is subjected to boot strap by being synchronized with an active timing of Qe node. To this end, the emission driver 121 may include a Qe node controller, a QBe node controller, an output unit, and a stabilizer.

The Qe node controller may be implemented as a first transistor Te1. The first transistor Te1 activates the Qe node by applying an emission start signal EVST or (k−1)th emission carry signal EMC(k−1) to the Qe node in accordance with an emission clock signal ECLK.

The QBe node controller activates the QBe node on the contrary to the Qe node in accordance with the emission clock signal ELCK, the emission start signal EVST or the (k−1)th emission carry signal EMC(k−1), and the Qe node. The QBe node controller may be implemented as a first capacitor CQ2, a second transistor Te2, a third transistor Te3, a fourth transistor Te4, and a second capacitor CQBe.

The first capacitor CQ2 is connected between an input terminal of the emission clock signal ECLK and the Qe node. The second transistor Te2 supplies the emission clock signal ECLK to the QBe node in accordance with a potential of Qe2 node. The third transistor Te3 supplies the emission high voltage VEH to the Qe2 node in accordance with the emission start signal EVST or the (k−1)th emission carry signal EMC(k−1). Therefore, the potential of the Qe2 node is changed by being synchronized with the emission clock signal ECLK for a time period when the emission start signal EVST or the (k−1)th emission carry signal EMC(k−1) is maintained as the gate off voltage. Also, the potential of the Qe2 node becomes the emission high voltage VEH for a time period when the emission start signal EVST or the (k−1)th emission carry signal EMC(k−1) is maintained as the gate on voltage.

The fourth transistor Te4 supplies the emission high voltage VEH to the QBe node in accordance with the potential of the Qe node. The second capacitor CQBe is connected between the QBe node and the emission high voltage VEH and stabilizes the potential of the QBe.

The output unit includes a sixth transistor Te6 which is a pull-down device, a seventh transistor Te1 which is a pull-up device, and a third capacitor CBe.

The sixth transistor Te6 supplies the emission signal EM(k) of the emission low voltage VEL to an output node E0 by being synchronized with an active timing of the Qe node from the time when the Qe1 node is subjected to boot strap. The third capacitor CBe is connected between the Qe1 node and the emission output node E0, and serves to boot strap the Qe1 node by reflecting a potential change of the emission output node E0 in the potential of the Qe1 node when the emission signal EM(k) is shifted from the emission high voltage VEH to the emission low voltage VEL. The seventh transistor Te1 supplies the emission signal EM(k) to the emission output node E0 for an active period of the QBe node prior to the Qe node.

The stabilizer may be implemented as a fifth transistor Te5. A gate of the fifth transistor Te5 is connected to an input terminal of the emission low voltage VEL, and first and second electrodes of the fifth transistor Te5 are respectively connected to the Qe node and the Qe1 node. A channel current between the first electrode and the second electrode of the fifth transistor Te5 becomes zero when the Qe1 node is subjected to boot strap. In other words, the fifth transistor Te5 is turned off when the Qe1 node is subjected to boot strap, thereby blocking electrical connection between the Qe node and the Qe1 node. The fifth transistor Te5 is maintained at a turn-on state while the Qe1 node is not being subjected to boot strap.

The fifth transistor Te5 is maintained at the turn-on state and then turned off only when the Qe1 node is subjected to boot strap, thereby blocking a current flow between the Qe node and the Qe1 node. Therefore, when the Qe1 node is subjected to boot strap, the potential of the Qe node becomes different from the potential of the Qe1 node. Since the potential of the Qe node is not changed even though the potential of the Qe1 node is changed at the time of boot strap, overload is not applied to the first transistor Te1 and the fourth transistor Te4 connected to the Qe node at the time of boot strap. If there is no fifth transistor Te5, a drain-source voltage of the first transistor Te1 and a gate-source voltage of the fourth transistor Te4 may be increased to a threshold value or more due to boot strap. If this overload continues, break down which destructs a device may occur. The sixth transistor Te6 allows the first transistor Te1 and the fourth transistor Te4 connected to the Qe node not to be broken down at the time of boot strap of the Qe1 node.

Therefore, the emission driver according to one aspect of the present disclosure outputs the $k^{th}$ emission signal EM(k) to the nth pixel row by shifting the (k−1)th emission carry signal EMC(k−1).

The electroluminescence display device including a gate driver according to the aspect of the present disclosure may be described as follows.

In the electroluminescence display device according to one aspect of the present disclosure, a gate driver comprised of a plurality of stages includes a $k^{th}$ stage ($1 \le k \le n$, n and k are natural numbers) for providing an emission signal to an nth pixel row, a first controller of the $k^{th}$ stage that is connected to the $k^{th}$ stage and providing an input signal, and a second controller of the $k^{th}$ stage that is connected to the $k^{th}$ stage and receiving an output signal of the $k^{th}$ stage as an input signal. The first controller is implemented to generate a control signal for sensing the nth pixel row, and the second controller is connected to an emission line, to which the emission signal is applied, to provide the output signal of the $k^{th}$ stage to the emission line, and the second controller is connected to a first controller of a $(k+1)^{th}$ stage to provide the output signal of the $k^{th}$ stage shifted to an emission carry signal to the first controller of the $(k+1)^{th}$ stage. In this case, n and k are natural numbers, and $1 \le k \le n$. Therefore, a random gate signal may selectively be applied to a specific pixel row to sense and compensate for the specific pixel row. As a result, non-uniform luminance of the display panel may be compensated in real time, whereby picture quality of the electroluminescence display device may be improved and its lifespan may be extended.

According to another characteristic of the present disclosure, the $k^{th}$ stage may provide the emission signal to an odd numbered pixel row and an even numbered pixel row, and k may be obtained by dividing n by 2.

According to still another characteristic of the present disclosure, the plurality of stages constituting the gate driver may be implemented as shift registers.

According to further still another characteristic of the present disclosure, a plurality of subpixels may be arranged in the nth pixel row, and each of the plurality of subpixels includes a light emitting diode and a pixel circuit, wherein the pixel circuit may include a driving transistor, a switching transistor, an emission transistor and a sensing transistor.

According to further still another characteristic of the present disclosure, the gate driver may further comprise a sensing scan driver for providing a sensing signal that controls the sensing transistor.

According to further still another characteristic of the present disclosure, the sensing scan driver may include a pull-down transistor controlled by a Qsp node to output a gate clock, and a pull-up transistor controlled by a QBs node to output a gate high voltage, and a sensing signal provided to the nth pixel row may be a signal in which the gate clock is adjusted.

According to further still another characteristic of the present disclosure, the first controller of the $k^{th}$ stage may include an eleventh transistor controlled by the QBs node to apply an emission carry signal of an (k−1)th stage to an output node of the first controller, a twelfth transistor controlled by the Qs node, and having one electrode connected to the output node of the first controller, a thirteenth transistor controlled by an output signal of the sensing scan driver, applying a sensing clock for selecting the nth pixel row to one electrode of the twelfth transistor, and a capacitor connected to the output node and a line to which an emission high voltage or an emission low voltage is applied, and the signal provided to the output node of the first controller may be provided as the input signal of the $k^{th}$ stage.

According to further still another characteristic of the present disclosure, the first controller may further include a fourteenth transistor and a first sub capacitor connected to the output node of the first controller, the fourteenth transistor may be controlled by the emission low voltage to apply a signal of the Qs node to the output node of the first controller, and the first sub capacitor may be connected to the output node and a node to which the sensing clock is input.

According to further still another characteristic of the present disclosure, the thirteenth transistor may include a $13A^{th}$ transistor controlled by an output signal of a sensing scan driver for providing a signal to the odd numbered pixel row and a $13B^{th}$ transistor controlled by an output signal of a sensing scan driver for providing a signal to the even numbered pixel row.

According to further still another characteristic of the present disclosure, the second controller may include a 21st transistor controlled by the QBs node to apply the output signal of the kth stage to an output node of the second controller, and a 22nd transistor controlled by the Qs node to apply an emission high voltage to the output node of the second controller.

According to further still another characteristic of the present disclosure, the second controller of the $k^{th}$ stage may further include a second sub capacitor between the QBs ode and a node to which the output signal of the kth stage is applied.

According to further still another characteristic of the present disclosure, the output node of the second controller may be connected to a gate of an emission transistor included in the nth pixel row.

According to further still another characteristic of the present disclosure, the kth stage may include a Qe node controller, a QBe node controller, an output unit, and a stabilizer.

According to further still another characteristic of the present disclosure, the gate driver may further include a sensing scan driver for providing a scan signal to the nth pixel row, and the first controller and the second controller may be operated by being synchronized with the sensing scan driver.

In the electroluminescence display device according to one aspect of the present disclosure, the electroluminescence display device comprises a sensing scan driver including a plurality of stages for applying a sensing signal to a specific pixel row; an emission driver including a plurality of stages for applying an emission signal to the specific pixel row; a first controller for providing an input signal to the emission driver; and a second controller for receiving an output signal of the emission driver as an input signal, wherein electrical characteristics of a driving device included in the specific pixel row are sensed through a sensing period, and a gate on voltage is output through the sensing scan driver and the emission driver during the sensing period. Therefore, a random gate signal may selectively be applied to the specific pixel row to sense and compensate for the specific pixel row. As a result, non-uniform luminance of the display panel may be compensated in real time, whereby picture quality of the electroluminescence display device may be improved and its lifespan may be extended.

According to another characteristic of the present disclosure, a pixel row prior to the specific pixel row and a pixel row after the specific pixel row may normally be driven to allow pixels to emit light.

According to still another characteristic of the present disclosure, the first controller may include a plurality of transistors and a capacitor, wherein the plurality of transistors may be controlled by a node constituting the sensing scan driver and the sensing signal to apply an output signal to an output node of the first controller.

According to further still another characteristic of the present disclosure, the second controller may include a plurality of transistors, wherein the plurality of transistors may be controlled by a node constituting the sensing scan driver to apply an output signal to an output node of the second controller.

According to further still another characteristic of the present disclosure, a sensing data voltage for sensing the specific pixel row may be applied to the specific pixel row for a data program period prior to the sensing period.

According to further still another characteristic of the present disclosure, the emission driver may include a plurality of stages, each of which applies the emission signal to the specific pixel row and a pixel row prior to the specific pixel row, and a black data voltage may be applied to the pixel row for the data program period.

It will be apparent to those skilled in the art that the present disclosure described above is not limited by the above-described aspects and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

The various aspects described above can be combined to provide further aspects. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects can be modified, if necessary to employ concepts of the various patents, applications and publications to provide yet further aspects.

These and other changes can be made to the aspects in light of the above-detailed description. In general, in the following claims, the terms used should not be construed to limit the claims to the specific aspects disclosed in the specification and the claims, but should be construed to include all possible aspects along with the full scope of equivalents to which such claims are entitled. Accordingly, the claims are not limited by the disclosure.

What is claimed is:

1. An electroluminescence display device including a gate driver comprised of a plurality of stages, the gate driver comprising:

a $k^{th}$ stage for providing an emission signal to an $n^{th}$ pixel row (where n and k are natural numbers and $1 \le k \le n$);

a first controller of the $k^{th}$ stage that is connected to the $k^{th}$ stage and providing an input signal;

a second controller of the $k^{th}$ stage that is connected to the $k^{th}$ stage and receiving an output signal of the $k^{th}$ stage as an input signal; and a sensing scan driver for providing a scan signal to the $n^{th}$ pixel row, wherein the first controller is implemented to generate a control signal for sensing the $n^{th}$ pixel row, wherein the second controller is connected to an emission line, to which the emission signal is applied, to provide the output signal of the $k^{th}$ stage to the emission line, and the second controller is connected to a first controller of a $(k+1)^{th}$ stage to provide the output signal of the $k^{th}$ stage shifted to an emission carry signal to the first controller of the $(k+1)^{th}$ stage, and wherein the first controller and the second controller are operated by being synchronized with the sensing scan driver.

2. The electroluminescence display device according to claim 1, wherein the $k^{th}$ stage provides the emission signal to two pixel rows including an odd numbered pixel row and an even numbered pixel row, and k is obtained by dividing n by 2.

3. The electroluminescence display device according to claim 1, wherein the plurality of stages constituting the gate driver are implemented as a shift register.

4. The electroluminescence display device according to claim 1, further comprising a plurality of subpixels arranged in the $n^{th}$ pixel row, each of the plurality of subpixels includes a light emitting diode and a pixel circuit, wherein the pixel circuit includes a driving transistor, a switching transistor, an emission transistor and a sensing transistor.

5. The electroluminescence display device according to claim 4, wherein the sensing scan driver provides a sensing signal that controls the sensing transistor.

6. The electroluminescence display device according to claim 5, wherein the sensing scan driver includes a pull-down transistor controlled by a Qsp node to output a gate clock, and a pull-up transistor controlled by a QBs node to output a gate high voltage, and a sensing signal provided to the $n^{th}$ pixel row is a signal in which the gate clock is adjusted.

7. The electroluminescence display device according to claim 6, wherein the first controller of the $k^{th}$ stage includes:

an eleventh transistor controlled by the QBs node to apply an emission carry signal of an $(k-1)^{th}$ stage to an output node of the first controller;

a twelfth transistor controlled by the Qs node and having one electrode connected to the output node of the first controller;

a thirteenth transistor controlled by an output signal of the sensing scan driver, applying a sensing clock for selecting the $n^{th}$ pixel row to one electrode of the twelfth transistor; and a capacitor connected to the output node and a line to which an emission high voltage or an emission low voltage is applied, and wherein the signal provided to the output node of the first controller is provided as the input signal of the $k^{th}$ stage.

8. The electroluminescence display device according to claim 7, wherein the first controller further includes a fourteenth transistor and a first sub capacitor connected to the output node of the first controller, and wherein the fourteenth transistor is controlled by the emission low voltage to apply a signal of the Qs node to the output node of the first controller, and the first sub capacitor is connected to the output node and a node to which the sensing clock is input.

9. The electroluminescence display device according to claim 7, wherein the thirteenth transistor includes a $13A^{th}$ transistor controlled by an output signal of a sensing scan driver for providing a signal to the odd numbered pixel row and a $13B^{th}$ transistor controlled by an output signal of a sensing scan driver for providing a signal to the even numbered pixel row.

10. The electroluminescence display device according to claim 6, wherein the second controller of the $k^{th}$ stage includes:

a 21st transistor controlled by the QBs node to apply the output signal of the $k^{th}$ stage to an output node of the second controller; and a 22nd transistor controlled by the Qs node to apply an emission high voltage to the output node of the second controller.

11. The electroluminescence display device according to claim 10, wherein the second controller further includes a second sub capacitor between the QBs node and a node to which the output signal of the $k^{th}$ stage is applied.

12. The electroluminescence display device according to claim 1, wherein the output node of the second controller is connected to a gate of an emission transistor included in the $n^{th}$ pixel row.

13. The electroluminescence display device according to claim 1, wherein the $k^{th}$ stage includes a Qe node controller, a QBe node controller, an output unit, and a stabilizer.

14. An electroluminescence display device comprising:

a sensing scan driver including a plurality of stages for applying a sensing signal to a specific pixel row;

an emission driver including a plurality of stages for applying an emission signal to the specific pixel row;

a first controller for providing an input signal to the emission driver; and a second controller for receiving an output signal of the emission driver as an input signal, wherein electrical characteristics of a driving device included in the specific pixel row are sensed through a sensing period, and a gate on voltage is output through the sensing scan driver and the emission driver during the sensing period.

15. The electroluminescence display device according to claim 14, wherein a pixel row prior to the specific pixel row and a pixel row after the specific pixel row are normally driven to allow pixels to emit light.

16. The electroluminescence display device according to claim 14, wherein the first controller includes a plurality of transistors and a capacitor, the plurality of transistors being controlled by a node constituting the sensing scan driver and the sensing signal to apply an output signal to an output node of the first controller.

17. The electroluminescence display device according to claim 14, wherein the second controller includes a plurality of transistors, the plurality of transistors being controlled by a node constituting the sensing scan driver to apply an output signal to an output node of the second controller.

18. The electroluminescence display device according to claim 14, wherein a sensing data voltage for sensing the specific pixel row is applied to the specific pixel row for a data program period prior to the sensing period.

19. The electroluminescence display device according to claim 18, wherein the emission driver includes a plurality of stages, each of which applies the emission signal to the specific pixel row and a pixel row prior to the specific pixel row, and a black data voltage is applied to the pixel row for the data program period.

* * * * *